US011515672B2

(12) United States Patent
Liao

(10) Patent No.: US 11,515,672 B2
(45) Date of Patent: Nov. 29, 2022

(54) ELECTRICAL CONNECTOR

(71) Applicant: BELLWETHER ELECTRONIC CORP., Taoyuan (TW)

(72) Inventor: Yen-Jang Liao, Taoyuan (TW)

(73) Assignee: BELLWETHER ELECTRONIC CORP., Taoyuan (TW)

( * ) Notice: Subject to any disclaimer, the term of this patent is extended or adjusted under 35 U.S.C. 154(b) by 0 days.

(21) Appl. No.: 17/334,882

(22) Filed: May 31, 2021

(65) Prior Publication Data

US 2021/0384679 A1 Dec. 9, 2021

Related U.S. Application Data

(60) Provisional application No. 63/034,405, filed on Jun. 4, 2020.

(51) Int. Cl.

| | |
|---|---|
| ***H01R 13/6471*** | (2011.01) |
| ***H01R 13/40*** | (2006.01) |
| ***H01R 13/20*** | (2006.01) |
| ***H01R 12/51*** | (2011.01) |

(52) U.S. Cl.

CPC ..... *H01R 13/6471* (2013.01); *H01R 12/51* (2013.01); *H01R 13/20* (2013.01); *H01R 13/40* (2013.01)

(58) Field of Classification Search

CPC ..... H01R 12/51; H01R 13/20; H01R 13/40; H01R 13/6461; H01R 13/6585; H01R 13/6471; H01R 13/6588; H01R 13/6474; H01R 13/6476

USPC ..... 439/181

See application file for complete search history.

(56) References Cited

U.S. PATENT DOCUMENTS

| | | | | |
|---|---|---|---|---|
| 10,103,492 | B2 * | 10/2018 | Ju | H01R 13/6597 |
| 10,320,126 | B2 * | 6/2019 | Ju | H01R 13/6583 |
| 11,063,385 | B2 * | 7/2021 | Gu | H05K 1/18 |
| 11,336,057 | B2 * | 5/2022 | Kawasaki | H01R 13/6471 |
| 2017/0025772 | A1 * | 1/2017 | Yu | H01R 13/6471 |
| 2017/0040721 | A1 * | 2/2017 | Tsai | H01R 13/502 |
| 2017/0194755 | A1 * | 7/2017 | Cheng | H01R 12/724 |
| 2017/0352968 | A1 * | 12/2017 | Zhang | H01R 13/6658 |
| 2017/0352973 | A1 * | 12/2017 | Zhang | H01R 13/6474 |

(Continued)

FOREIGN PATENT DOCUMENTS

| | | | | |
|---|---|---|---|---|
| CN | 113314869 A | * | 8/2021 | H01R 13/6471 |
| TW | M595347 U | * | 5/2020 | |

*Primary Examiner* — Marcus E Harcum

(74) *Attorney, Agent, or Firm* — Li & Cai Intellectual Property (USA) Office

(57) ABSTRACT

An electrical connector is provided. The electrical connector includes a metal plate, a first-row terminal assembly, and a second-row terminal assembly. A hollow area of the metal plate has a first projection area on a projection plane that is parallel to the metal plate, and a contact area of the second power terminal set has a second projection area overlapping the first projection area on the projection plane. The first projection area has a first border line and a second border line. The second projection area has a third border line and a fourth border line. The first border line and the third border line have a first projection distance therebetween. The second border line and the fourth border line have a second projection distance therebetween. The first projection distance and the second projection distance are both 0.2 mm or more.

21 Claims, 23 Drawing Sheets

(56) References Cited

U.S. PATENT DOCUMENTS

| | | | | |
|---|---|---|---|---|
| 2017/0373439 | A1* | 12/2017 | Wen | H01R 13/405 |
| 2018/0076581 | A1* | 3/2018 | Tsai | H01R 13/6585 |
| 2019/0013627 | A1* | 1/2019 | Zhao | H01R 13/6594 |
| 2020/0136315 | A1* | 4/2020 | Tanaka | H01R 13/6585 |
| 2020/0381871 | A1* | 12/2020 | Oosaka | H01R 24/60 |
| 2021/0203104 | A1* | 7/2021 | Chen | H01R 13/405 |
| 2021/0320465 | A1* | 10/2021 | Tada | H01R 24/60 |

* cited by examiner 2
21
22

ELECTRICAL CONNECTOR

CROSS-REFERENCE TO RELATED PATENT APPLICATION

This application claims priority to the U.S. Provisional Patent Application Ser. No. 63/034,405, filed on Jun. 4, 2020, which application is incorporated herein by reference in its entirety.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to an electrical connector, and more particularly to an electrical connector that can be used to avoid structural damage caused by an electric arc effect.

BACKGROUND OF THE DISCLOSURE

An electric arc effect may occur during mating, disconnection, and use between an electrical connector and external terminals or external connecting members. The electric arc effect is a phenomenon in which the air around a tip of a conductor is ionized by an electrical field generated by the conductor, causing an electrical current to pass through a medium (such as air) that is an insulator in a normal state. The electric arc effect may cause damage to transmission systems, distribution systems, and electronic equipment, such as damaging plug terminals and socket terminals, thereby affecting their electrical conductivity.

Therefore, how to improve a structural design to reduce the electric arc effect or avoid damage to an internal structure of the electrical connector caused by an electric arc has become one of the important issues to be solved in the related field.

SUMMARY OF THE DISCLOSURE

In response to the above-referenced technical inadequacy, the present disclosure provides an electrical connector.

In one aspect, the present disclosure provides an electrical connector which includes a metal plate, a first-row terminal assembly, and a second-row terminal assembly. The metal plate has a hollow area. The first-row terminal assembly is disposed on one side of the metal plate, and the first terminal assembly includes at least one first signal terminal. The second-row terminal assembly is disposed on another side of the metal plate. The second-row terminal assembly is opposite to the first-row terminal assembly. The second-row terminal assembly includes a second power terminal set, a second ground terminal set, and at least one second signal terminal. A contact area of the second power terminal set is configured in physical to contact with one terminal set of a mating electrical connector when the contact area of the second power terminal set is mated with the mating electrical connector. The hollow area has a first projection area on a projection plane that is parallel to the metal plate, the contact area of the second power terminal set has a second projection area on the projection plane, and the first projection area completely overlaps the second projection area. The first projection area has a first border line and a second border line that are opposite to each other, and the second projection area has a third border line and a fourth border line that are opposite to each other. The first border line and the third border line have a first projection distance therebetween, the second border line and the fourth border line have a second projection distance therebetween, and the first projection distance and the second projection distance are both 0.2 mm or more.

In another aspect, the present disclosure provides an electrical connector, which includes a metal plate, a first-row terminal assembly, and a second-row terminal assembly. The metal plate is divided into a shield segment and an electric arc suppression segment by a boundary line. The boundary line extends along a mating direction. The metal plate includes a main body part, and the main body part is arranged in the shield segment. The first-row terminal assembly is disposed on one side of the metal plate. The first-row terminal assembly includes at least one first signal terminal, and the at least one first signal terminal extends along the mating direction. The second-row terminal assembly is disposed on another side of the metal plate. The second-row terminal assembly is opposite to the first-row terminal assembly. The second-row terminal assembly includes a second power terminal set, a second ground terminal set, and at least one second signal terminal. The second power terminal set, the second ground terminal set, and the at least one second signal terminal extend along the mating direction and are arranged along an alignment direction. The alignment direction is perpendicular to the mating direction. The second ground terminal set, the at least one first signal terminal, and the at least one second signal terminal are arranged in the shield segment, and the second power terminal set is arranged in the electric arc suppression segment. A contact area of the second power terminal set is configured in physical to contact with one terminal set of a mating electrical connector when the contact area of the second power terminal set is mated with the mating electrical connector. An edge of the contact area of the second power terminal set and the boundary line are spaced apart from each other in the alignment direction.

Therefore, one of the beneficial effects of the present disclosure is that, in the electrical connector provided by the present disclosure, by virtue of "the hollow area having the first projection area on the projection plane that is parallel to the metal plate, the contact area of the second power terminal set having the second projection area on the projection plane, the first projection area overlapping the second projection area, the first projection area having the first border line and the second border line that are opposite to each other, the second projection area having the third border line and the fourth border line that are opposite to each other, the first border line and the third border line having the first projection distance therebetween, the second border line and the fourth border line having the second projection distance therebetween, and the first projection distance and the second projection distance both being 0.2 mm or more" and "the second ground terminal set, the at least one first signal terminal, and the at least one second signal terminal being arranged in the shield segment, and the second power terminal set being arranged in the electric arc suppression segment", a quiet zone surrounding terminals is enlarged to avoid damage to the structure surrounding the terminals caused by an electric arc effect.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
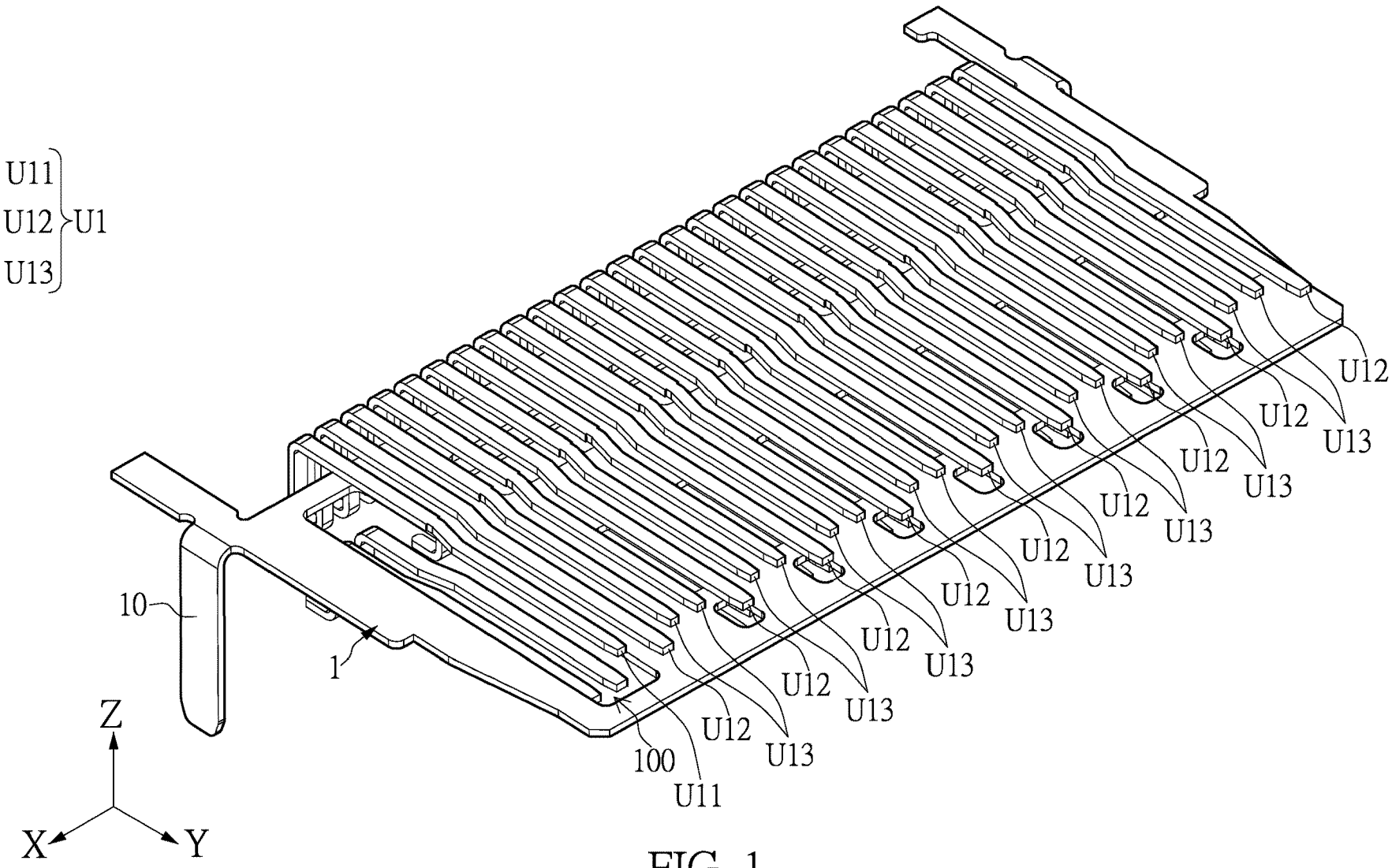
FIG. 1 is a schematic perspective view of a metal plate, a first-row terminal assembly, and a second-row terminal assembly of an electrical connector according to the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Embodiment

In an electrical connector of the present disclosure, there is an increased distance between a grounded metal plate and power terminals, and the metal plate functions as a shield, so that an electric arc effect between the metal plate and the power terminals can be avoided or controlled when the power terminals receive or transmit a higher power voltage. In the electrical connector of the present disclosure, a shield segment and an electric arc suppression segment are divided by a boundary line and the boundary line extends along a mating direction (i.e., the boundary line can be non-linear, but is substantially parallel to the mating direction). The mating direction refers to a direction in which the electrical connector is mated with a mating electrical connector. The electrical connector has a metal plate arranged therein. A main body part of the metal plate is arranged in the shield segment to provide a shielding effect, and power terminal(s) in the electric connector for receiving a high potential is(are) arranged in the electric arc suppression segment. The metal plate does not extend into the electric arc suppression segment, or only a part of an extension arm extends into the electric arc suppression segment, so that a shortest distance between the power terminal(s) and the main body part as well as the extension arm is greater than or equal to a predetermined distance. The predetermined distance is determined according to a highest potential received, so as to avoid the electric arc. The following examples are provided to further illustrate the electrical connector of the present disclosure.

Referring to FIG. 1 to FIG. 4, FIG. 1 to FIG. 4 are perspective views of a metal plate, a first-row terminal assembly, and a second-row terminal assembly of an electrical connector from different viewing angles according to the present disclosure. The present disclosure provides an electrical connector (reference can be made to FIG. 14 and FIG. 15 for a full configuration of the electrical connector of the present disclosure), which includes a metal plate 1, a first-row terminal assembly U1, and a second-row terminal assembly U2. The metal plate 1 is disposed between the first-row terminal assembly U1 and the second-row terminal assembly U2, and is electrically connected to a ground potential to provide a shielding effect. The first-row terminal assembly U1 is disposed on one side of the metal plate 1 (i.e., being above the metal plate 1). Specifically speaking, in the present embodiment, the first-row terminal assembly U1 includes a first power terminal set, a first ground terminal set, and at least one signal terminal U13 that are arranged in parallel to each other. The first power terminal set includes at least one first power terminal U11, and the first ground terminal set includes at least one first ground terminal U12. Each of the first power terminals U11 of the first power terminal set is adjacent to another, and each of the first ground terminals U12 of the first ground terminal set is also adjacent to another. The second-row terminal assembly U2 includes a second power terminal set, a second ground terminal set, and at least one second signal terminal U23 that are arranged in parallel to each other along an alignment direction. The second power terminal set includes at least one second power terminal U21, and the second ground terminal set includes at least one second ground terminal U22. Each of the second power terminals U21 of the second power terminal set is adjacent to another, and each of the second ground terminals U22 of the second ground terminal set is also adjacent to another. It should be noted that, a quantity of the first power terminals U11 of the first power terminal set, a quantity of the first ground terminals U12 of the first ground terminal set, and a quantity of the first signal terminals U13 are not limited in the present disclosure. For example, in the present embodiment, the quantity of the first power terminals U11 of the first power terminal set is one, the quantity of the first ground terminals U12 of the first ground terminal set is one, and the quantity of the first signal terminals U13 is two or more. In addition, the first signal terminals U13 are provided in duplicate. Similarly, a quantity of the second power terminals U21, a quantity of the second ground terminals U22, and a quantity of the second signal terminals U23 are not limited in the present disclosure. For example, in the present embodiment, the quantity of the second power terminals U21 of the second power terminal set is two, the quantity of the second ground terminals U22 of the second ground terminal set is two, and the quantity of the second signal terminals U23 is two or more.

Accordingly, in the present embodiment, the first power terminal U11, a plurality of the first ground terminals U12, and multiple pairs of the first signal terminals U13 are arranged along an alignment direction, and the at least one first power terminal U11, the at least one first ground terminal U12, and the at least one first signal terminal U13 extend along the above-mentioned mating direction. It should be noted that, in the present embodiment, the alignment direction is parallel to an X-axis, and the mating direction is parallel to a Y-axis, so that the alignment direction is perpendicular to the mating direction. It is worth mentioning that, in the present disclosure, the plurality of first ground terminals U12 and the multiple pairs of the first signal terminals U13 are arranged in a staggered manner. That is, any two of the adjacent first signal terminals U13 are arranged between two first ground terminals U12. Each pair of the first signal terminals U13 is used to provide differential signals. In addition, the mating direction is a direction (a positive Y-axis direction) along which the electrical connector of the present disclosure is mated with a mating electrical connector.

Referring further to FIG. 1 to FIG. 4, the second-row terminal assembly U2 is disposed on another side of the metal plate 1 (i.e., being below the metal plate 1), such that the second-row terminal assembly U2 is opposite to the first-row terminal assembly U1. In addition, the second-row terminal assembly U2 further includes a detection terminal set, which includes a plurality of detection terminals U24 that are adjacent to each other. In the present embodiment, the two second power terminals U21, a plurality of the second ground terminals U22, a plurality of the second signal terminals U23, and the plurality of detection terminals U24 are arranged in a staggered manner along the above-mentioned alignment direction (being parallel to the X-axis), and the two second power terminals U21, the plurality of second ground terminals U22, the plurality of second signal terminals U23, and the plurality of detection terminals U24 extend along the above-mentioned mating direction (being parallel to the Y-axis). The second power terminal set is electrically connected to an external power potential. The external power potential is provided by the mating electrical connector. The power potential can be provided by a direct current or an alternating current with a maximum potential value being 24 V or greater.

Figure 5:
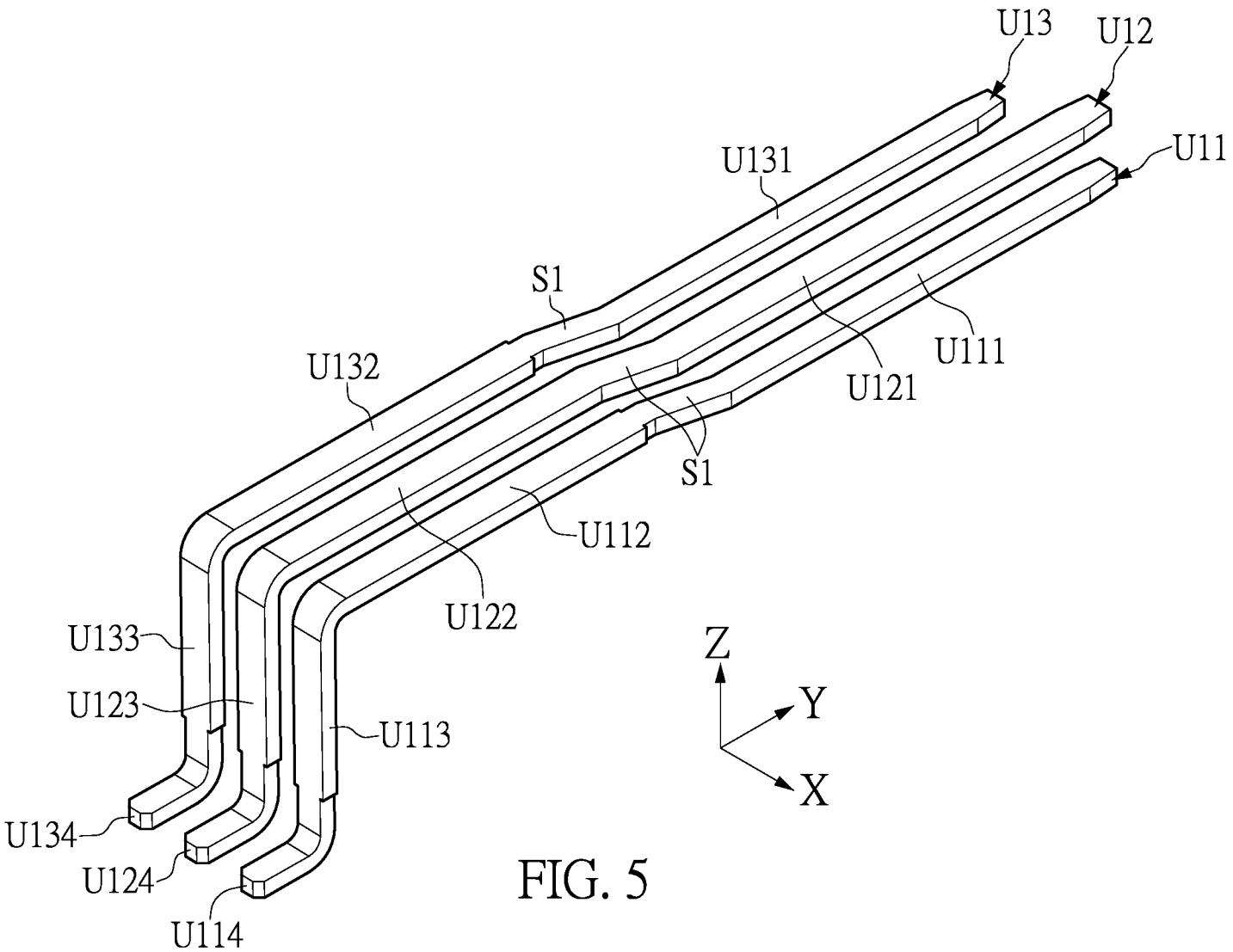
FIG. 5 is a schematic perspective view of a first power terminal, a first terminal, and a first signal terminal of the electrical connector according to the present disclosure.
Figure 6:
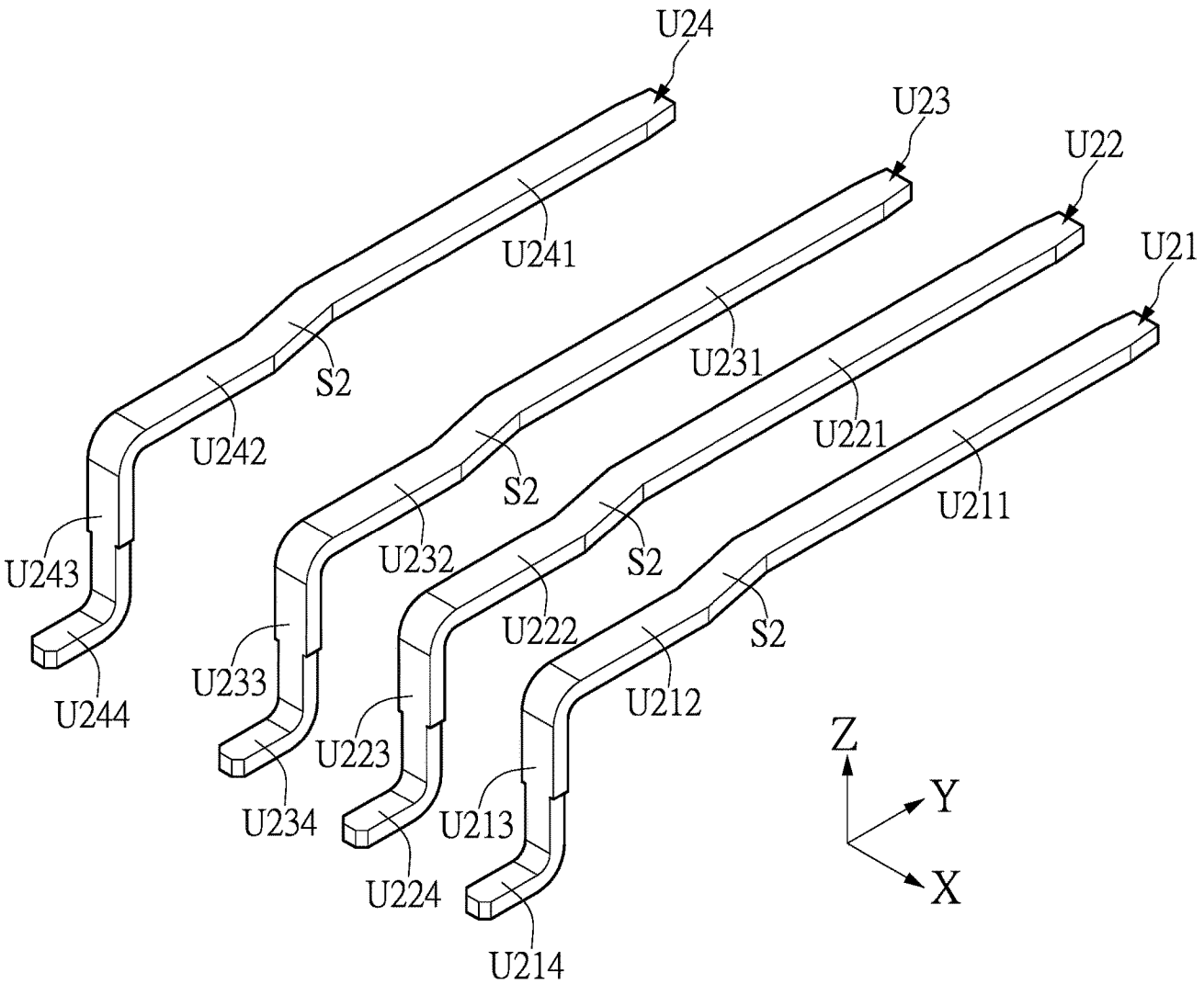
FIG. 6 is a schematic perspective view of a second power terminal, a second ground terminal, a second signal terminal, and a detection terminal of the electrical connector according to the present disclosure.

Referring to FIG. 5 and FIG. 6, each terminal (any terminal of the first-row terminal set U1 and the second-row terminal set U2) of the electrical connector of the present disclosure extends along the mating direction to form a contact area, and such contact area serves a function of being in physical contact with a corresponding terminal of the mating electrical connector. More specifically, FIG. 5 is exemplified by having one first power terminal U11, one first ground terminal U12, and one first signal terminal U13, and FIG. 6 is exemplified by having one second power terminal U21, one second ground terminal U22, one second signal terminal U23, and one detection terminal U24. The contact area mentioned above is a first segment U111 to U131 of each terminal (the first power terminal U11, the first ground terminal U12, and the first signal terminal U13) of the first-row terminal assembly U1, and a fifth segment U211 to U241 of each terminal (the second power terminal U21, the second ground terminal U22, the second signal terminal U23, and the detection terminal U24) of the second-row terminal assembly U2. In addition, as shown in FIG. 5 and FIG. 6, the contact area (the first segment U111 to U131 and the fifth segment U211 to U241) is parallel to the positive Y axis.

Figure 3:
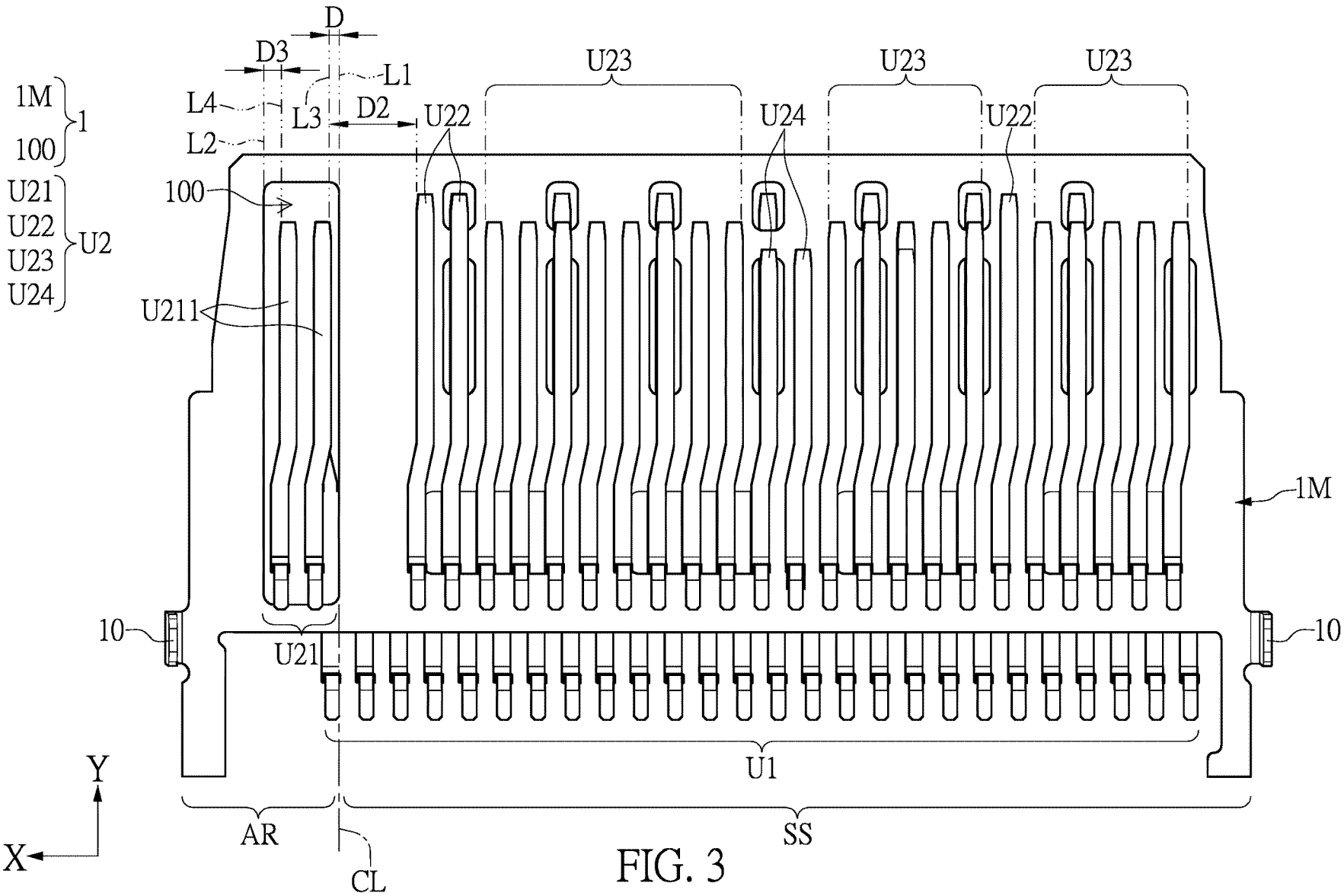
FIG. 3 is a schematic bottom view of the metal plate, the first-row terminal assembly, and the second-row terminal assembly of the electrical connector according to the present disclosure.
Figure 4:
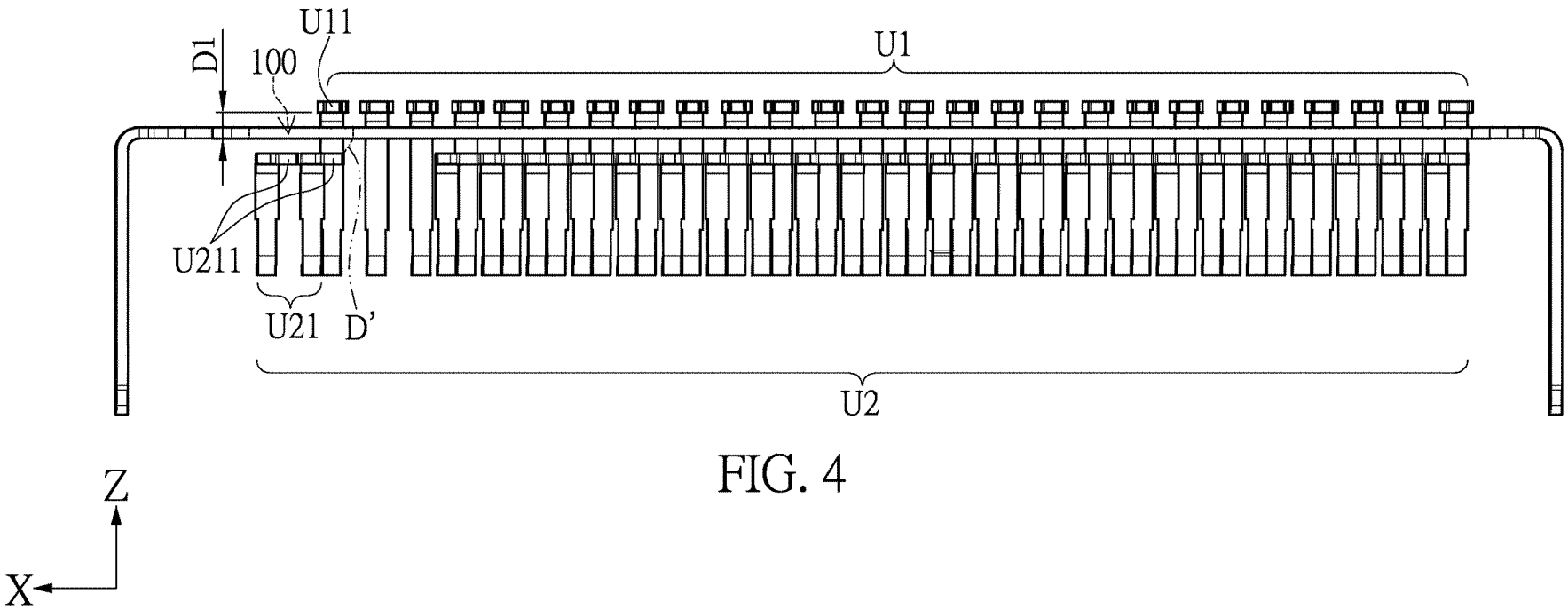
FIG. 4 is a schematic front view of the metal plate, the first-row terminal assembly, and the second-row terminal assembly of the electrical connector according to the present disclosure.

Referring further to FIG. 3 and FIG. 4, the fifth segment U211 (i.e., the contact area) of each of the second power terminals U21 overlaps a hollow area 100 of the metal plate 1 as viewed from a Z-axis. FIG. 3 is a schematic bottom view of the metal plate, the first-row terminal assembly, and the second-row terminal assembly according to the present disclosure, and FIG. 4 is a schematic front view of the metal plate, the first-row terminal assembly, and the second-row terminal assembly according to the present disclosure. Furthermore, FIG. 3 can be regarded as a schematic view showing the metal plate 1, the first-row terminal assembly U1, and the second-row terminal assembly U2 being projected on the same projection plane. In other words, the hollow area 100 has a first projection area (the first projection area being the hollow area 100) on a projection plane that is parallel to the metal plate 1. The fifth segments U211 of the two power terminals U21 have a second projection area on the projection plane (the fifth segments U211 of the two power terminals U21 being the second projection area), and the first projection area entirely overlaps the second projection area (i.e., the second projection area positions are completely within the first projection area). It should be noted that, the above-mentioned projection plane is perpendicular to the Z-axis, i.e., being parallel to the metal plate 1; or, the projection plane is parallel to a XY plane formed by the X-axis and the Y-axis.

Referring further to FIG. 3, the electrical connector can be divided into a shield segment SS and an electric arc suppression segment AR by a boundary line CL, and the metal plate 1 has a main body part 1M disposed on the shield SS. The boundary line CL extends along a Y-axis (the boundary line CL can be non-linear, but is substantially parallel to the Y-axis). In the present embodiment, a first border line L1 of the hollow area 100 that is adjacent to the main body part 1M overlaps the boundary line CL. Moreover, the boundary line CL overlaps the first border line L1 and divides the electrical connector along the first border line L1 into the shield segment SS and the electric arc suppression segment AR. At least one extension arm of the metal plate 1 (referring to extension arms 104, 105, 106 in FIG. 7) extends from the main body part 1M into the electrical arc suppression segment AR and forms the hollow area 100, but the present disclosure is not limited thereto. In another embodiment, the metal plate 1 can have only the main body part 1M without any extension arm extending to the electrical arc suppression segment AR.

Referring further to FIG. 3 and FIG. 4, the first projection area of the hollow area 100 has the first border line L1 and a second border line L2 that is opposite to the first border line L1, and the second projection area has a third border line L3 and a fourth border line L4 that is opposite to the third border line L3. The first border line L1 and the third border line L3 have a first projection distance D therebetween, and the second border line L2 and the fourth border line L4 have a second projection distance D3 therebetween. The first projection distance D and the second projection distance D3 are each 0.2 mm or more, and preferably 0.3 mm or more. In addition, the second power terminal (including the two second power terminals U21) is arranged on the electric arc suppression segment AR, and edges of the fifth segments U211 of the two second power terminals U21 and the boundary line CL are arranged in a staggered manner from each other along the alignment direction. In other words, a spatially shortest distance D' between the fifth segments U211 of the two second power terminals U21 and a surrounding of the hollow area 100 (i.e., the main body part 1M and the extension arms 104, 105, 106) is greater than the first projection distance D1. In addition, in the present embodiment, the shortest distance D' between the second power terminal set and the hollow area 100 (i.e., the shortest distance between the hollow area 100 and the fifth segment U211 of the second power terminal U21 that is closer to the main body part 1M) is 0.23 mm or more, and preferably 0.34 mm or more.

In the present embodiment, except for the first power terminal U11 and the two second power terminals U21, all other terminals are arranged in the shield segment SS. That is to say, the plurality of first ground terminals U12, the plurality of first signal terminals U13, the plurality of second ground terminals U22, the plurality of second signal terminals U23, and the plurality of detection terminals U24 are all arranged in the shield segment SS. However, in practical application, if there are other power terminals in an electrical connector Z1 required for connecting to a lower power potential (i.e., being lower than 24 V), such power terminals for the lower power potential can also be arranged in the shield segment SS without affecting the electric arc effect of the present disclosure.

Figure 2:
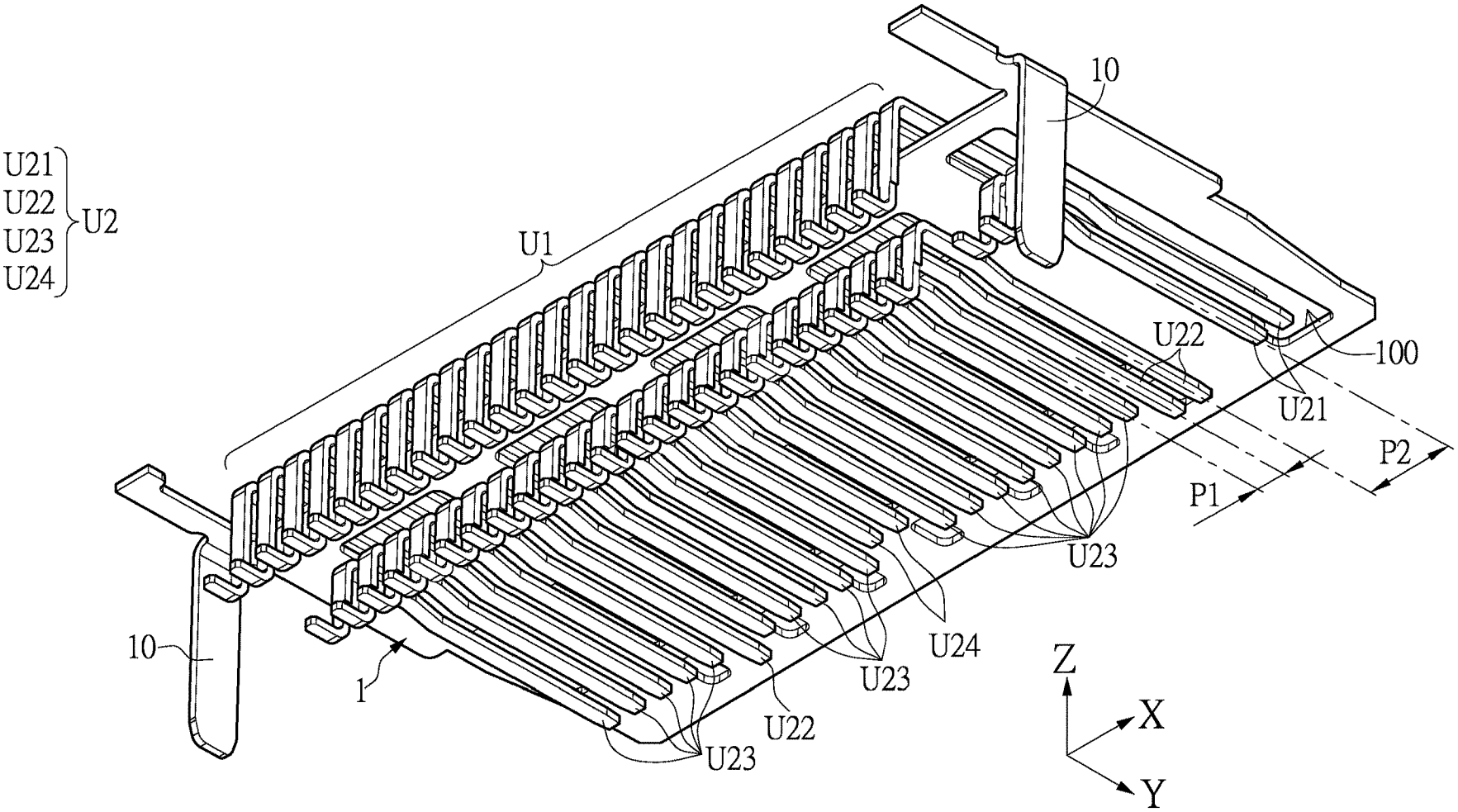
FIG. 2 is another schematic perspective view of the metal plate, the first-row terminal assembly, and the second-row terminal assembly of the electrical connector according to the present disclosure.

Referring further to FIG. 1 and FIG. 2, the first ground terminal set and the second ground terminal set are adjacent to the hollow 100. As shown in FIG. 1, one of the first ground terminals U12 of the first ground terminal set is arranged in the shield segment SS and is adjacent to the hollow area 100, so as to suppress electromagnetic interference of the first power terminal U11 to the plurality of first signal terminals U13. A pin pitch of other terminals of the first-row terminal assembly U1 (i.e., the plurality of first ground terminals U12 and the plurality of first signal terminals U13) is less than or equal to a pin pitch between the first power terminal U11 and the first ground terminal U12 that are adjacent to each other in the first power terminal set and the first ground terminal set. Similarly, as shown in FIG. 2, the second ground terminal set is adjacent to the hollow area 100, so as to suppress electromagnetic interference of the second power terminal U21 to the plurality of second signal terminals U23 and the plurality of detection terminals U24. A second pin pitch P2 between the second power terminal U21 and the second ground terminal U22 that are adjacent to each other in the second power terminal set and the second ground terminal set is greater than a first pin pitch P1 between other terminals of the second-row terminal assembly U2 (i.e., the plurality of second ground terminals U22, the plurality of second signal terminals U23, and the plurality of detection terminals U24). For example, as shown in FIG. 3, the second ground terminal set (the two second ground terminals U22) and the at least one second signal terminal U23 are arranged at the first pin pitch P1, the second ground terminal set and the second power terminal set are adjacent to each other and spaced apart at the second pin pitch P2, and the second pin pitch P2 is greater than the first pin pitch P1. In other words, a pin pitch between two terminals that are adjacent to the boundary line (or the first border line L1) is greater than or equal to a pin pitch between other terminals that are adjacent to each other. Moreover, in the present disclosure, two terminals between the second power terminal U21 and the second ground terminal U22 are omitted, so that the second power terminal U21 and the second ground terminal U22 are adjacent to each other. Therefore, a pin pitch thereof is three times another pin pitch. Accordingly, a pin pitch between any two terminals can be increased in the present disclosure by removing all terminals between the any two terminals. That is, the increased pin pitch is an integer multiple of another pin pitch, and is two times or more.

Quantities of the terminals in the first power terminal set and the terminals in the second power terminal set are determined according to a maximum current to be transmitted. In addition, a maximum current value can be increased by increasing a width of the power terminal (the first power terminal or the second power terminal). That is to say, a terminal width of the first power terminal U11 is greater than or equal to a terminal width of the first ground terminal U12 and the first signal terminal U13. A terminal width of the second power terminal U21 is greater than or equal to a terminal width of the second ground terminal U22, the second signal terminal U23, and the second detection terminal U24. Preferably, a quantity of the terminals in the first power terminal set is the same as a quantity of the terminals in the first ground terminal set, and a quantity of the terminals in the second power terminal set is the same as a quantity of the terminals in the adjacent second ground terminal set.

Figure 7:
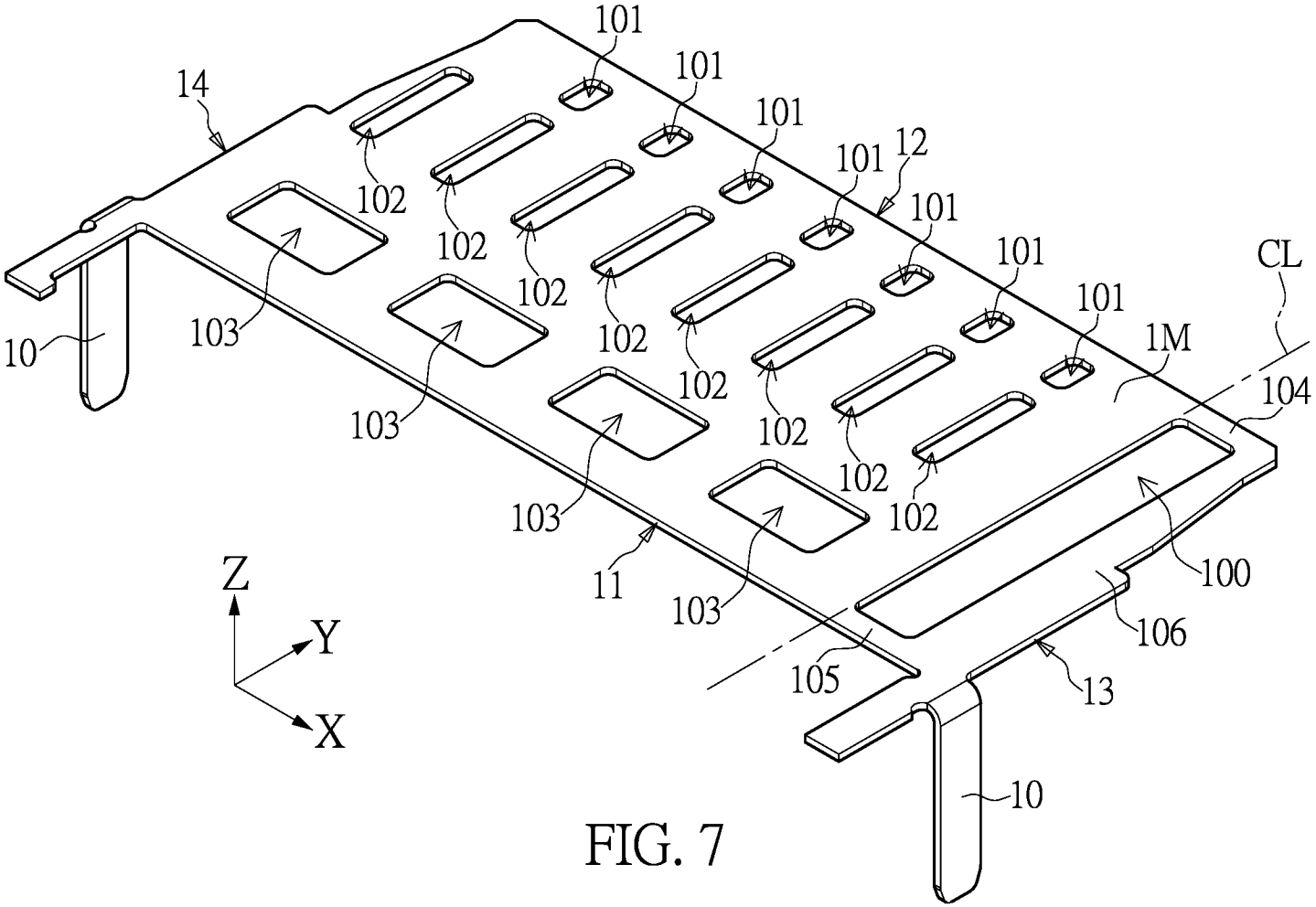
FIG. 7 is a schematic perspective view of the metal plate of the electrical connector according to the present disclosure.
Figure 8:
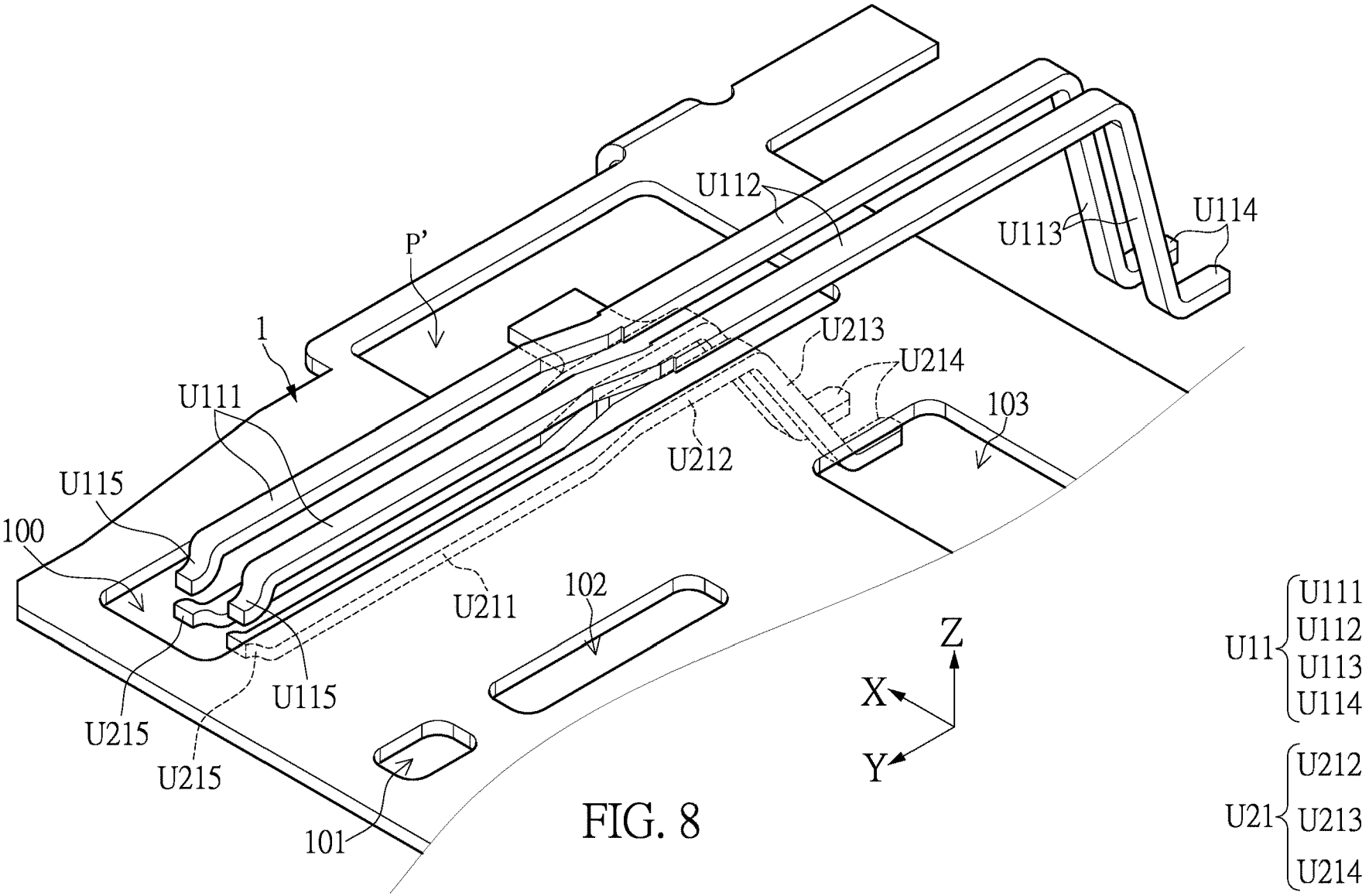
FIG. 8 is a schematic perspective view of the first power terminal, the second power terminal, and the metal plate of the electrical connector according to another embodiment of the present disclosure.

FIG. 7 is a schematic perspective view of the metal plate of the electrical connector according to the present disclosure. The wide-range hollow area 100 is arranged in the metal plate 1. The hollow area 100 is adjacent to the main body part 1M of the metal plate 1, and is surrounded by the extension arms 104, 105 on two sides thereof and the extension arm 106 on an outer side thereof (being connected to the extension arms 104, 105). In the present embodiment, the hollow area 100 is a closed hollow hole in the metal plate 1. The hollow area 100 can also be a hollow open recess according to particular implementations. That is to say, a part of the surrounding of the hollow area 100 is defined by some of the three extension arms 104, 105, 106.

Referring further to FIG. 3 and FIG. 4, the first ground terminal set is arranged adjacent to the first power terminal set, i.e., the first power terminal set is not adjacent to any of the first signal terminals U13. That is to say, one first ground terminal set must be arranged between the first power terminal set and any of the first signal terminals U13. The second ground terminal set is arranged adjacent to the second power terminal set, i.e., the second power terminal set is not adjacent to any of the second signal terminals U23 and the detection terminal set. The second power terminal U21 in the second power terminal set and the second ground terminal U22 in the second ground terminal set, adjacent to each other, are set by a predetermined distance D2.

As mentioned above, two of the second signal terminal U23 are respectively disposed on two sides of the detection terminal set. Preferably, the detection terminal set includes two of the detection terminals U24 that are adjacent to each other. It should be noted that, the detection terminal as described in the previous embodiment is disposed inside the second-row terminal assembly U2, or may be disposed inside the first-row terminal assembly U1 according to particular implementations. The first-row terminal assembly U1 and the second-row terminal assembly U2 may also each have the detection terminal set without affecting a detection function of the detection terminal.

The first power terminal set is arranged opposite to the second power terminal set, and the first power terminal set is spaced apart from the second power terminal set by a predetermined distance D1, i.e., the first power terminal set and the second power terminal set are both disposed in the electric arc suppression segment AR. It is worth mentioning that, in the present disclosure, the first predetermined distance D1 is greater than the projection distance D and the shortest distance D', the second predetermined distance D2 is greater than the first predetermined distance D1, and the second predetermined distance D2 is 0.6 mm or more. For example, the first predetermined distance D1 is 0.46 mm, and the second predetermined distance D2 is 1.25 mm, but the present disclosure is not limited thereto. In this way, in the present disclosure, a surrounding area of a quiet zone in an electric arc-prone area of the first power terminal set and the second power terminal is increased, so as to prevent the surrounding structure from being damaged due to the electric arc generated by the second power terminal U21 during conduction of electricity. In addition, through the above-mentioned order of distances D2, D1, D', and D, if the electric arcing occurs, a point of occurrence of the electric arcing can be restricted and an impact of structural damage can be reduced.

Referring again to FIG. 7, the main body part 1M of the metal plate 1 further has a plurality of first openings 101 that are spaced apart at intervals, a plurality of second openings 102 that are spaced apart at intervals, and a plurality of third openings 103 that are spaced apart at intervals. The plurality of first openings 101, the plurality of second openings 102, and the plurality of third openings 103 are arranged in parallel to each other. At least parts of the first openings 101, the plurality of second openings 102, and the plurality of third openings 103 serve as positioning through holes used for positioning purposes during assembly. In addition, the metal plate 1 includes a first side 11, a second side 12 that is opposite to the first side 11, a third side 13, and a fourth side 14 that is opposite to the third side 13. Moreover, the third side 13 and the fourth side 14 of the metal plate 1 each extend downwardly (the negative Z-axis) to form a first plugging part 10, and the first side 11 is arranged between the two first plugging parts 10. The first plugging part 10 is used to connect to a ground pad or a ground hole of a circuit board, such that the metal plate 1 is grounded, thereby providing the shielding effect. The plurality of third openings 103 are adjacent to the first side 11, the plurality of first openings 101 are adjacent to the second side 12, and the plurality of second openings 102 are arranged between the plurality of first openings 101 and the plurality of third openings 103.

Referring further to FIG. 5, FIG. 5 is a schematic perspective view of the first power terminal, the first ground terminal, and the first signal terminal of the electrical connector according to the present disclosure. Each of the terminals U11 to U13 of the first-row terminal assembly U1 (only one for each of the terminals U11 to U13 is shown in FIG. 5 for illustrative purposes, but the quantity of the terminals is not limited thereto) includes the first segment U111 to U131, a second segment U112 to U132 that is connected to the first segment U111 to U131, a third segment U113 to U133 that is connected to the second segment U112 to U132, and a fourth segment U114 to U134 that is connected to the third segment U113 to U133. The second segment U112 to U132 is connected between the first segment U111 to U131 and the third segment U113 to U133. The third segment U113 to U133 is connected between the second segment U112 to U132 and the fourth segment U114 to U134, and is bent downwardly relative to the second segment U112 to U132. The fourth segment U114 to U134 is bent upwardly relative to the third segment U113 to U133. In addition, the first segment U111 to U131 and the second segment U112 to U132 have a first turning segment S1 therebetween. That is, one end of the first turning segment S1 is connected to the first segment U111 to U131, and another end of the first turning segment S1 is connected to the second segment U112 to U132, such that an extension direction of the first segment U111 to U131 and an extension direction of the second segment U112 to U132 are not on the same line.

Referring further to FIG. 6, FIG. 6 is a schematic perspective view of the second power terminal, the second ground terminal, the second signal terminal, and the detection terminal of the electrical connector according to the present disclosure. Each of the terminals U21 to U24 of the second-row terminal assembly U2 (only one for each of the terminals U21 to U24 is shown in FIG. 6 for illustrative purposes, but the quantity of the terminals is not limited thereto) includes the fifth segment U211 to U241, a sixth segment U212 to U242 that is connected to the fifth segment U211 to U241, a seventh segment U213 to U243 that is connected to the sixth segment U212 to U242, and an eighth segment U214 to U244 that is connected to the seventh segment U213 to U243. The sixth segment U212 to U242 is connected between the fifth segment U211 to U241 and the seventh segment U213 to U243. The seventh segment U213 to U243 is connected between the sixth segment U212 to U242 and the eighth segment U214 to U244, and is bent downwardly relative to the sixth segment U212 to U242. The eighth segment U214 to U244 is bent upwardly relative to the seventh segment U213 to U243. In addition, the fifth segment U211 to U241 and the sixth segment U212 to U242 have a second turning segment S2 therebetween. That is, one end of the second turning segment S2 is connected to the fifth segment U211 to U241, and another end of the second turning segment S2 is connected to the sixth segment U212 to U242, such that an extension direction of the fifth segment U211 to U241 and an extension direction of the sixth segment U212 to U242 are not on the same line.

It should be noted that, through the design of the first turning segment S1 and the second turning segment S2, when being connected to the circuit board, the fourth segment U114 to U134 of the first-row terminal assembly U1 and the eighth segment U214 to U244 of the second-row terminal assembly U2 are arranged in a staggered manner. That is, the first segment U111 to U141 of the first-row terminal assembly U1 and the fifth segment U211 to U241 of the second-row terminal assembly U2 that are utilized as the contact area are aligned with each other on the Z-axis (except at an empty pin), while the fourth segment U114 to U134 and the eighth segment U214 to U244 that are utilized as the pins are arranged in a staggered manner.

In the present disclosure, lengths of the terminals in the first-row terminal assembly U1 may be different, and lengths of the terminals in the second-row terminal assembly U2 may also be different. Accordingly, a connected order of different terminals in the electrical connector Z1 during mating can be determined. Referring to FIG. 1 and FIG. 5, the first-row terminal assembly U1 is arranged in the positive Y-axis direction (the mating direction), and the first ground terminal U12 is adjacent to the first signal terminal U13. A foremost end of the first ground terminal U12 (i.e., one end of the first segment U121) is arranged in front of a foremost end of the adjacent first signal terminal U13 (i.e., one end of the first segment U131). A foremost end of the first power terminal U11 of the first power terminal set (i.e., one end of the first segment U111) is arranged in back of the foremost end of the first ground terminal U12 of the first ground terminal set, and in front of the foremost end of the first signal terminal U13. Preferably, the foremost end of each of the plurality of first ground terminals U12 is arranged at the same position, and the foremost end of each of the plurality of first signal terminal U13 is arranged at the same position. In addition, in another embodiment, if the quantity of the first power terminals U11 is more than one, the foremost end of each of the plurality of first power terminals U11 is also arranged at the same position.

Referring to FIG. 2 and FIG. 6, the second-row terminal assembly U2 is arranged in the positive Y-axis direction (the mating direction), and the second ground terminal U22 is adjacent to the second signal terminal U23. A foremost end of the second ground terminal U22 (i.e., a free end of the fifth segment U221) is arranged in front of a foremost end of the adjacent second signal terminal U23 (i.e., a free end of the fifth segment U231). A foremost end of the second power terminal U21 of the second power terminal set (i.e., a free end of the fifth segment U211) is arranged in back of the foremost end of the second ground terminal U22 of the second ground terminal set, and in front of the foremost end of the second signal terminal U23. A foremost end of any of the detection terminals U24 of the detection terminal set (i.e., a free end of the fifth segment U241) is arranged in back of the foremost ends of all of the second ground terminals U22 and the foremost ends of all of the second signal terminals U23. Preferably, the foremost end of each of the second power terminals U21 is arranged at the same position, the foremost end of each of the second ground terminals U22 is arranged at the same position, and the foremost end of each of the second signal terminals U23 is arranged at the same position. Accordingly, the foremost end of the detection terminal set is arranged in back of the first signal terminal U13 and the second signal terminal U23, i.e., the foremost end of the detection terminal U24 is arranged in back of all of the terminals (including the terminals of the first-row terminal assembly U1 and the terminals of the second-row terminal assembly U2). In this way, the detection terminal U24 is the last terminal to be connected when the electrical connector Z1 is mated with the mating electrical connector, and a signal representing completion of mating can be transmitted to a system, so as to determine that the mating of the electrical connector Z1 is completed.

Referring to FIG. 8 to FIG. 11, FIG. 8 to FIG. 11 illustrate another embodiment of the first power terminal U11, the second power terminal U21 and the metal plate 1. It should be noted that, the another embodiment shown in FIG. 8 to FIG. 11 is not limited to the first power terminal set and the second power terminal set, but can be applied to the first-row terminal assembly U1 including the first power terminal set, and the second-row terminal assembly U2 including the second power terminal set. For the sake of illustration, only the first power terminal U11 and the second power terminal U21 are shown as examples herein to respectively represent each of the terminals U11 to U13 of the first-row terminal assembly U1 and each of the terminals U21 to U24 of the second-row terminal assembly U2. Specifically speaking, the first power terminal U11 of the first-row terminal assembly U1 includes the first segment U111, the second segment U112, the third segment U113, and the fourth segment U114. The first segment U111 can further include a first bent segment U115 that is bent downwardly. That is to say, one end of the first segment U111 that is used as a free end is the first bent segment U115, and another end of the first segment U111 is connected to the second segment U112. The second power terminal U21 of the second-row terminal assembly U2 includes the fifth segment U211, the sixth segment U212, the seventh segment U213, and the eighth segment U214. The fifth segment U211 further includes a second bent segment U215 that is bent upwardly, and the second bent segment U215 is arranged at a free end of the fifth segment U211. That is to say, one end of the fifth segment U211 that is used as the free end is the second bent segment U215, and another end of the fifth segment U211 is connected to the sixth segment U212. The first bent segment U115 to U135 and the second bent segment U215 to U245 are both bent inwardly toward the metal plate 1. Such a design allows the foremost end of the terminal to be not deflected due to friction or collision when being mated, so as to ensure the electrical connector to work properly.

Figure 10:
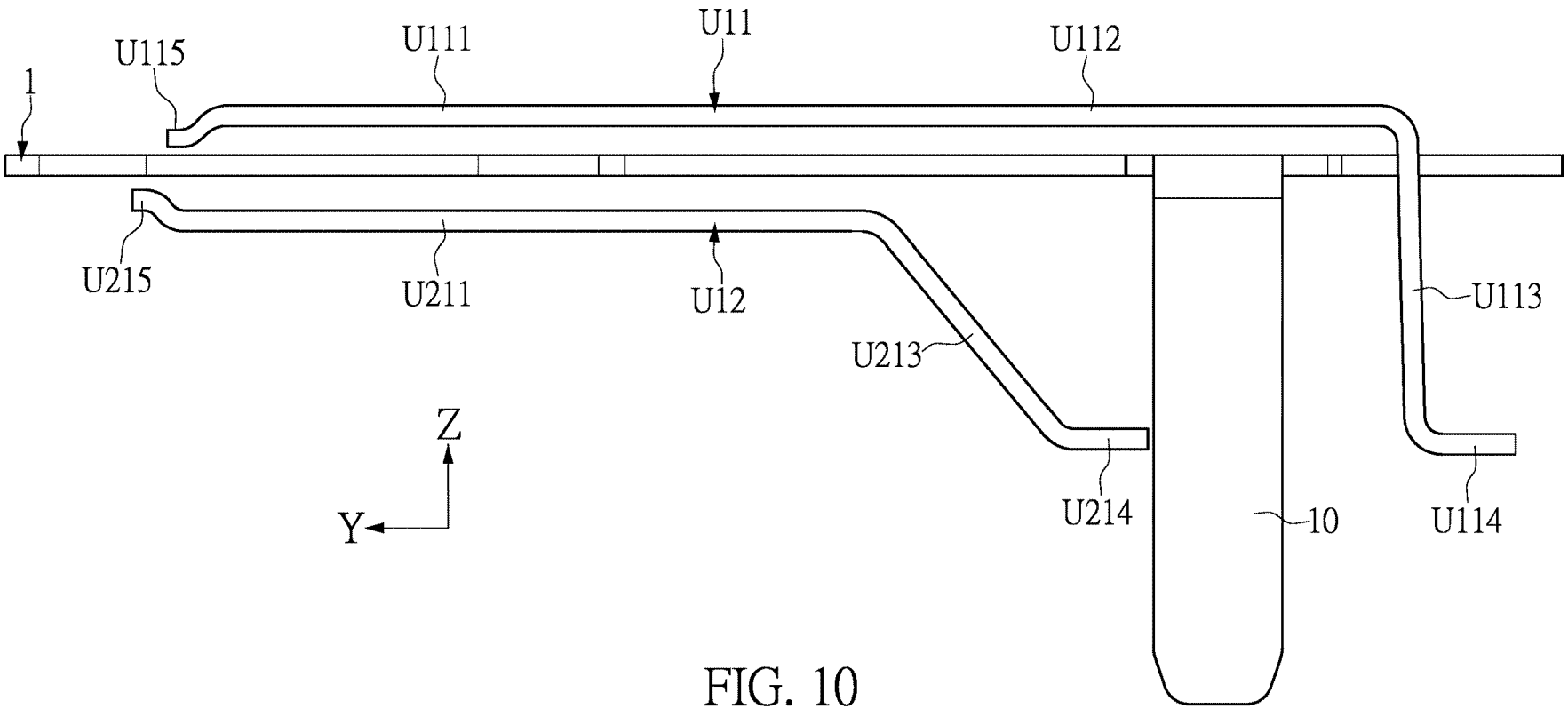
FIG. 10 is a schematic side view of the first power terminal, the second power terminal, and a hollow area of the metal plate of the electrical connector according to another embodiment of the present disclosure.

Referring further to FIG. 10, the seventh segment U213 to U243 is bent downwardly relative to the sixth segment U212 to U242 at an acute angle (FIG. 10 showing the seventh segment U213 as an example), or at a right angle as shown in FIG. 6, such that the seventh segment U213 to U243 is perpendicular to the sixth segment U212 to U242. The reasoning behind the bending design is mainly to allow a shortest distance between the seventh segment U213 to U243 and the metal plate 1 to be not smaller than a shortest distance between the sixth segment U212 to U242 and the metal plate 1 when the second power terminal U21 spans the extension arm 105 of the metal plate 1. Therefore, a distance of an overlapping between the projection of the second power terminal U21 and the projection of the metal plate 1 is also maintained to be greater than or equal to the shortest distance D' required to avoid the electric arc. Referring again to FIG. 8, the first power terminal U11 is used to electrically connect to a lower power potential, so that the sixth segment U112 of the first power terminal U11 is bent only after spanning the extension arm 105 (i.e., being connected to the seventh segment U113). In addition, the foremost end of the second power terminal U21 is arranged in front of the first power terminal U11.

Figure 9:
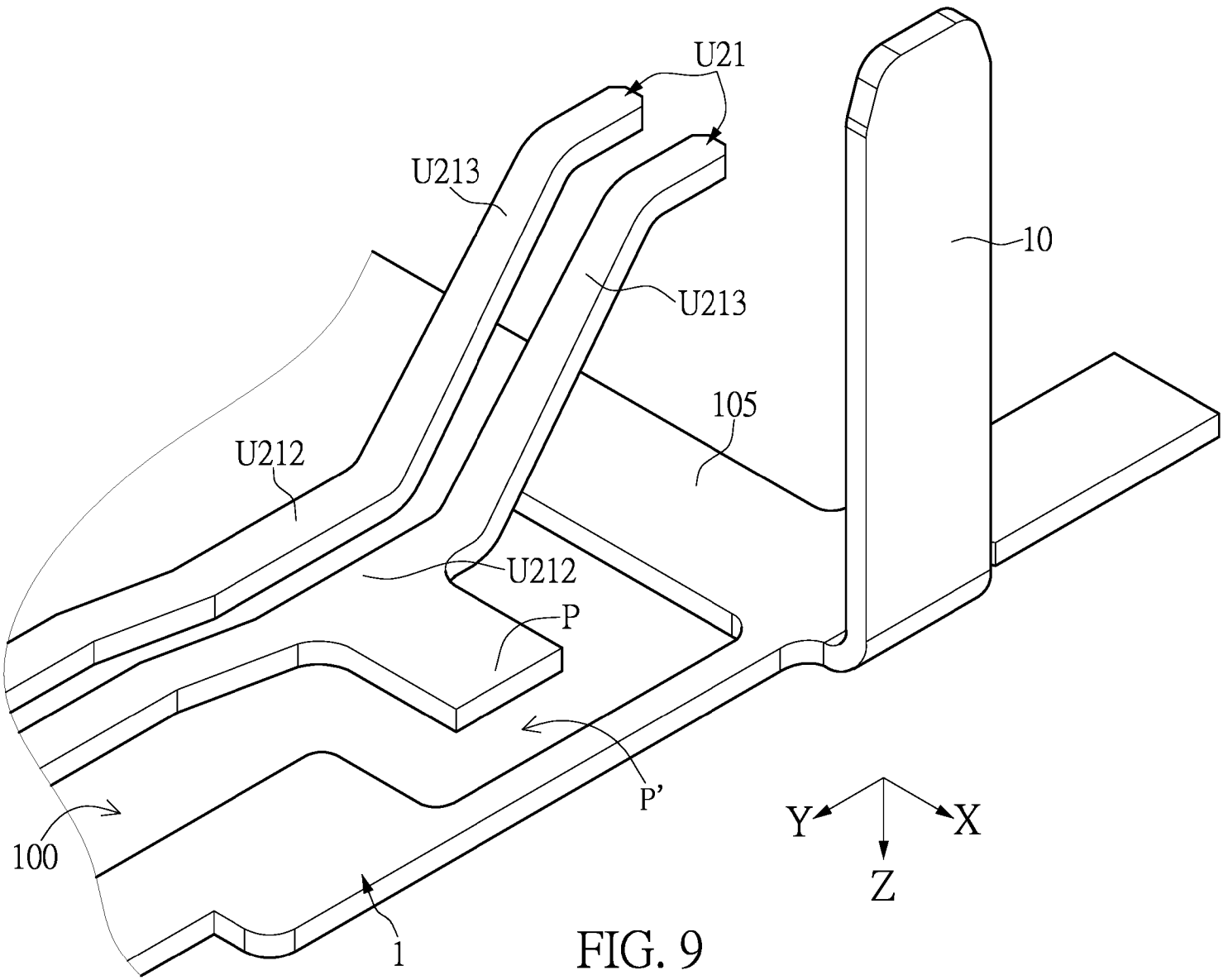
FIG. 9 is another schematic perspective view of the first power terminal, the second power terminal, and the metal plate of the electrical connector according to another embodiment of the present disclosure.
Figure 11:
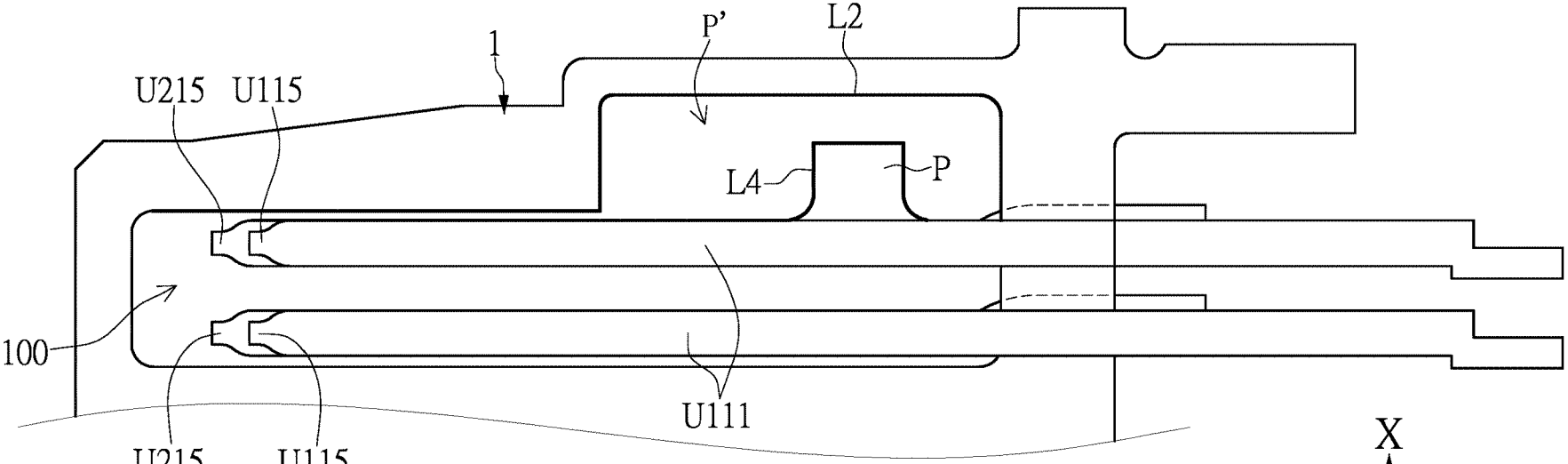
FIG. 11 is a schematic top view of the first power terminal, the second power terminal, and the hollow area of the metal plate of the electrical connector according to another embodiment of the present disclosure.

Referring further to FIG. 9 and FIG. 11, scrap is easily formed on side edges of the terminal due to how the electrical connector is manufactured. If scrap P is formed on one side of one of the second power terminals U21, a region in the hollow area 100 corresponding to the scrap P is also enlarged to form an additional convex area P'. A projection area of the convex area P' on the aforementioned projection plane can be arranged on one of the first border line L1 and the second border line L2. In the present disclosure, the convex area P' is arranged on the second border line L2 (comparing FIG. 3 with FIG. 11). Accordingly, in the present disclosure, a range of the hollow area 100 of the metal plate 1 can be adjusted. That is, the hollow area 100 is enlarged, so that the hollow area 100 further overlaps the scrap P, and a quiet zone surrounding the scrap P is formed to prevent the electric arc from being generated in the scrap P by the second power terminal U21 that is used as the power terminal. As shown in FIG. 11, the second power terminal U21 has the scrap P, and the hollow area 100 has the convex area P' corresponding to the scrap P, such that the second border line L2 of the first projection area of the hollow area 100 on the projection plane and the fourth border line L4 of the second projection area of the second power terminal U21 on the projection plane form a staggered arrangement (referring to a thick line shown in FIG. 11). The first power terminal U11 and the second power terminal U21 are aligned with each other. Each of the contact area of the first power terminal U11 (i.e., the first segment U111) has a third projection area on the projection plane that is parallel to the metal plate 1, and the third projection area overlaps the first projection area of the hollow area 100.

Figure 12:
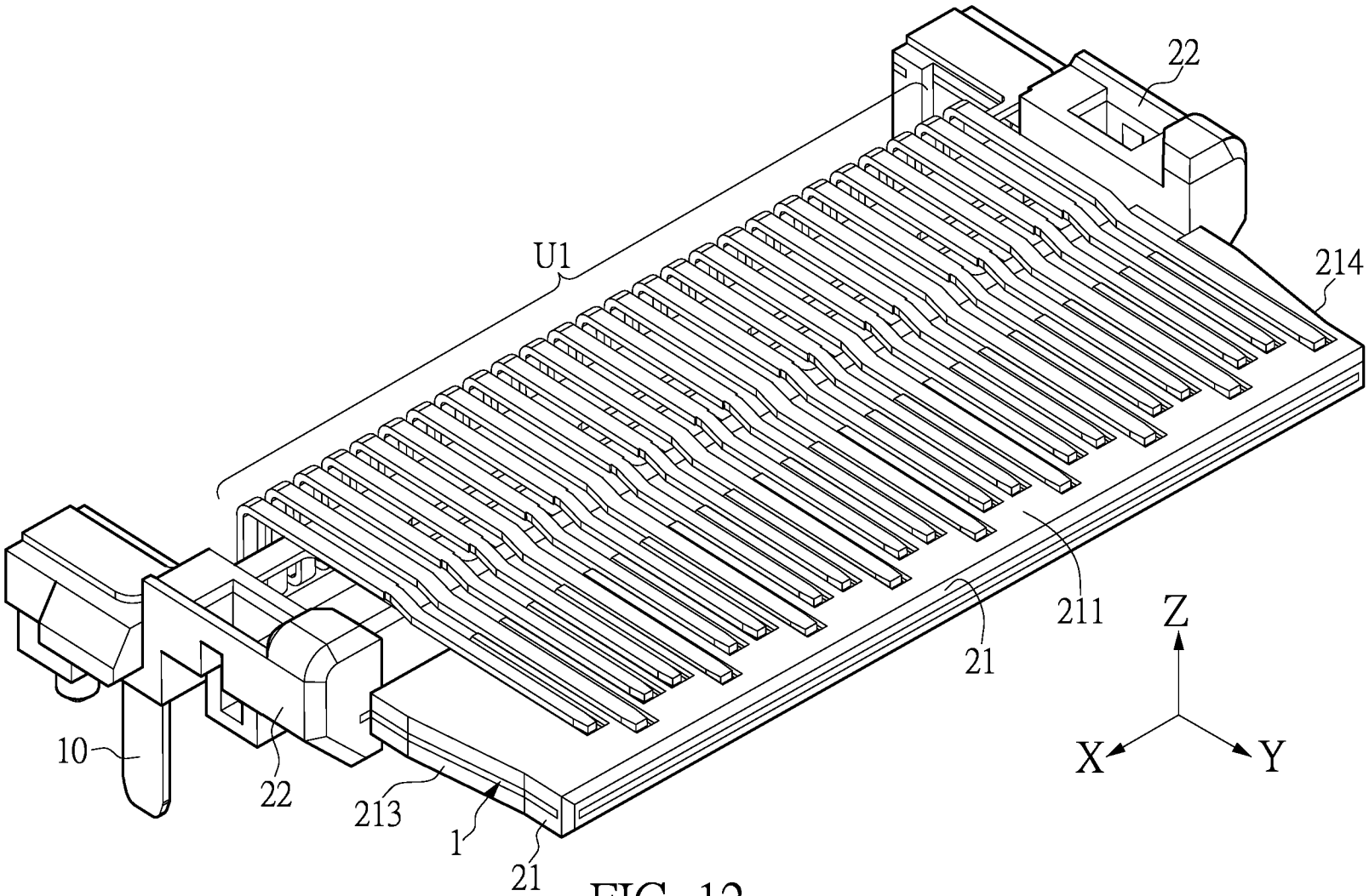
FIG. 12 is a schematic perspective view of an insulating housing, the first-row terminal assembly, and the second-row terminal assembly of the electrical connector according to the present disclosure.
Figure 13:
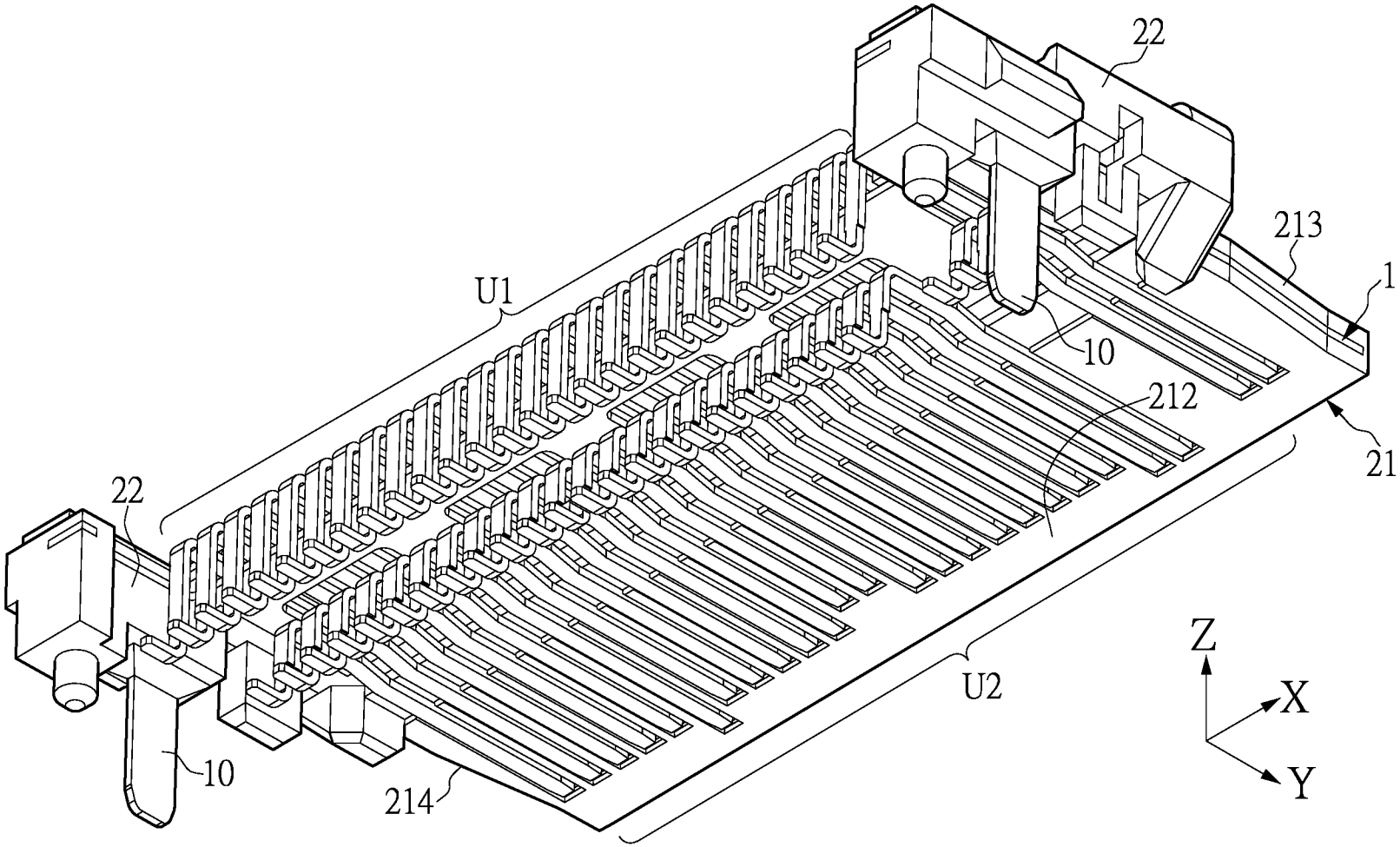
FIG. 13 is another schematic perspective view of the insulating housing, the first-row terminal assembly, and the second-row terminal assembly of the electrical connector according to the present disclosure.

Referring to FIG. 12 and FIG. 13, FIG. 12 and FIG. 13 are schematic perspective views of an insulating housing, the first-row terminal assembly, and the second-row terminal assembly of the electrical connector according to the present disclosure. The electrical connector further includes an insulating housing 2. The insulating housing 2 includes a tongue structure 21 and two wing structures 22 that are respectively connected to two sides of the tongue structure 21, and a part of the metal plate 1 is embedded in the tongue structure 21. Specifically speaking, except for the two first plugging parts 10 respectively on two sides of the metal plate 1, the rest of the metal plate 1 is embedded in the tongue structure 21. The two first plugging parts 10 respectively on the two sides of the metal plate 1 correspond to the two wing structures 22. The tongue structure 21 has a first plate surface 211 and a second plate surface 212 that are opposite to each other. Specifically speaking, the first plate surface 211 and the second plate surface 212 each have a plurality of recesses (not shown in the figures) corresponding to the first-row terminal assembly U1 and the second-row terminal assembly U2. It should be noted that, the first-row terminal assembly U1, the second-row terminal assembly U2, and the metal plate 1 are embedded in the insulating housing 2 by insert molding. In addition, the tongue structure 21 has a first short side 213 and a second short side 214 that are opposite to each other, and the two wing structures 22 are respectively connected to the first short side 213 and the second short side 214. The at least one first power terminal U11 and the second power terminal U21 are arranged adjacent to the first short side 213.

Figure 14:
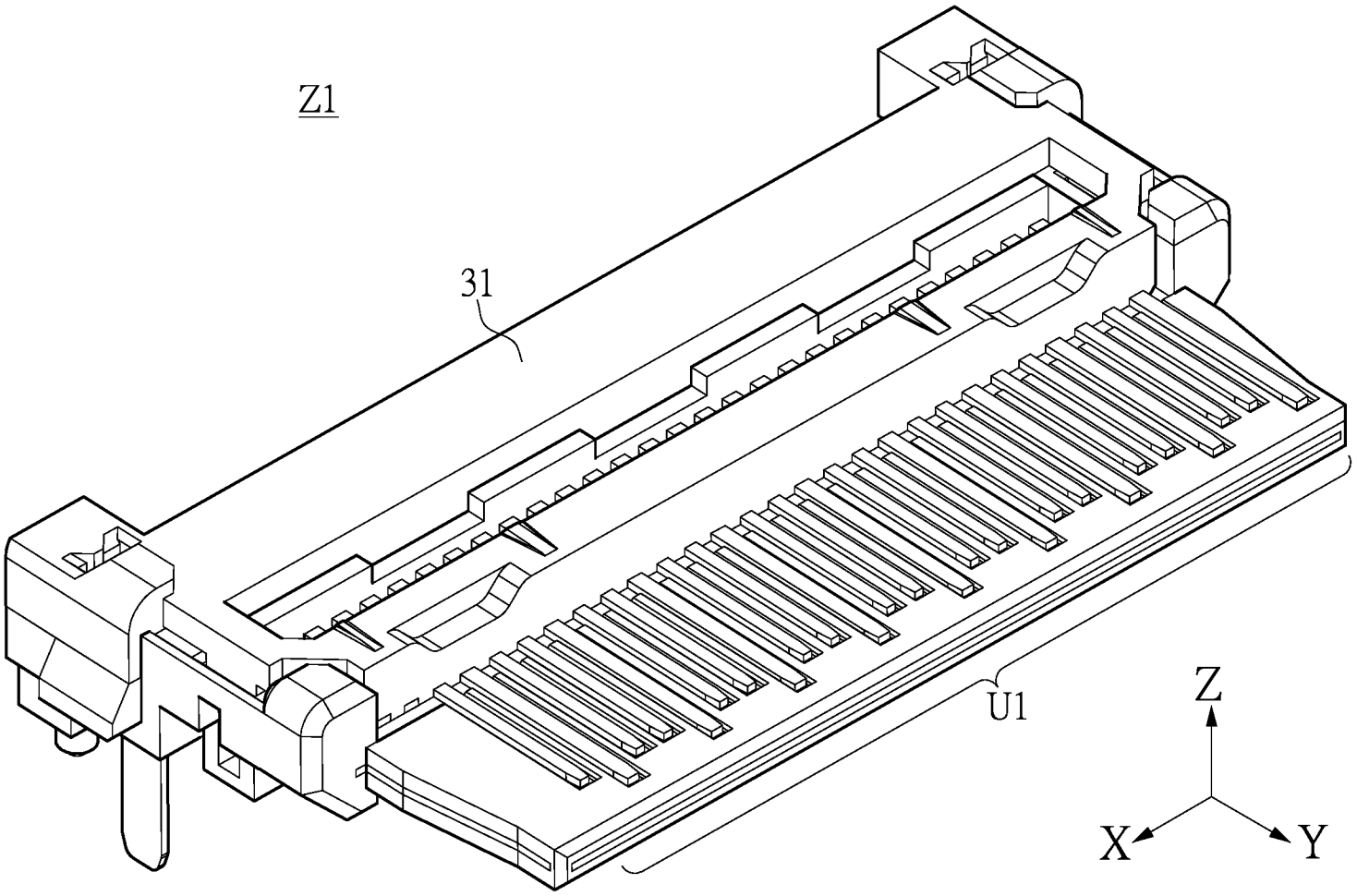
FIG. 14 is a schematic perspective view of a first cover body, a second cover body, the insulating housing, the first-row terminal assembly, and the second-row terminal assembly of the electrical connector according to the present disclosure.
Figure 15:
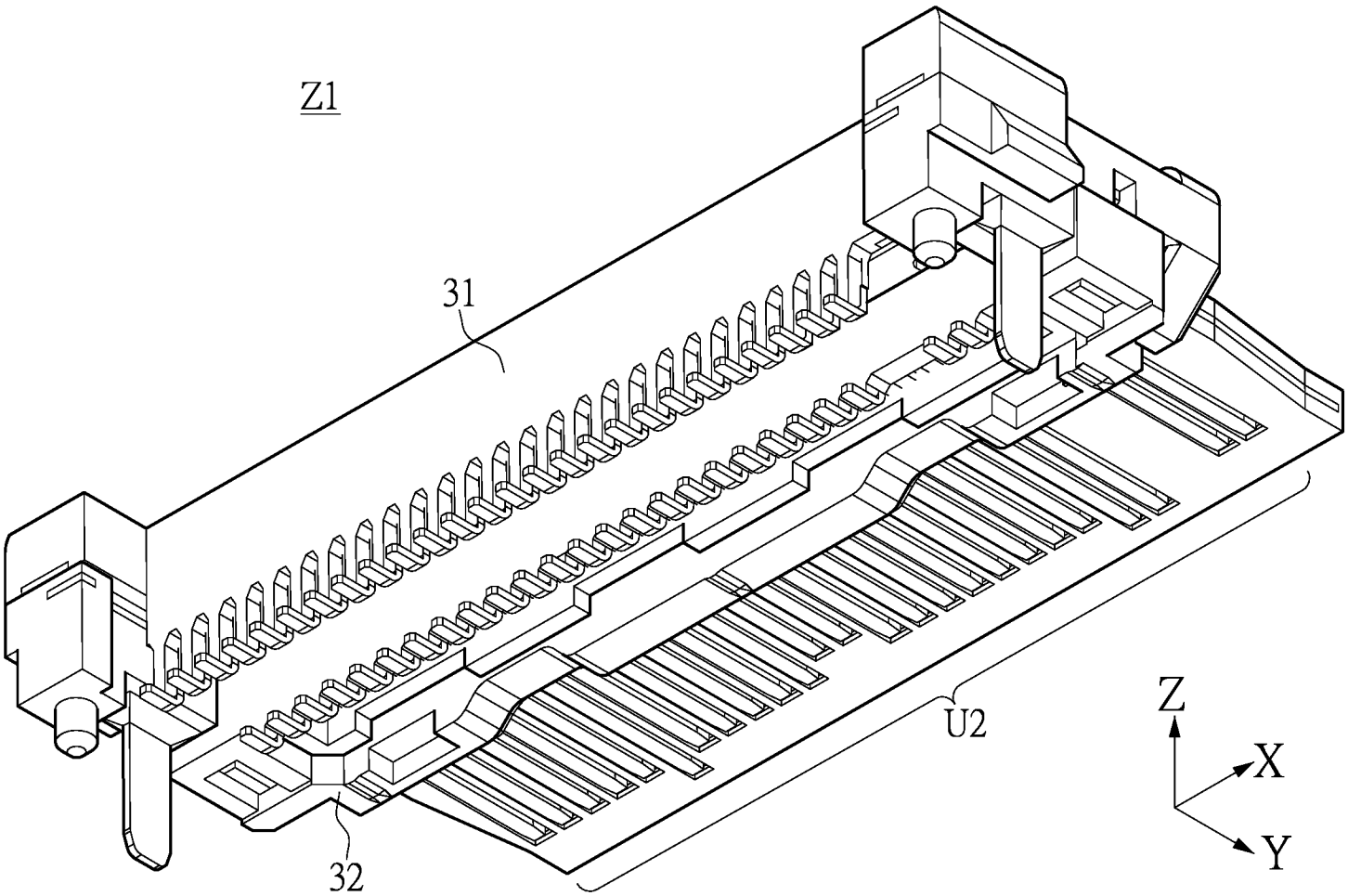
FIG. 15 is another schematic perspective view of the first cover body, the second cover body, the insulating housing, the first-row terminal assembly, and the second-row terminal assembly of the electrical connector according to the present disclosure.
Figure 16:
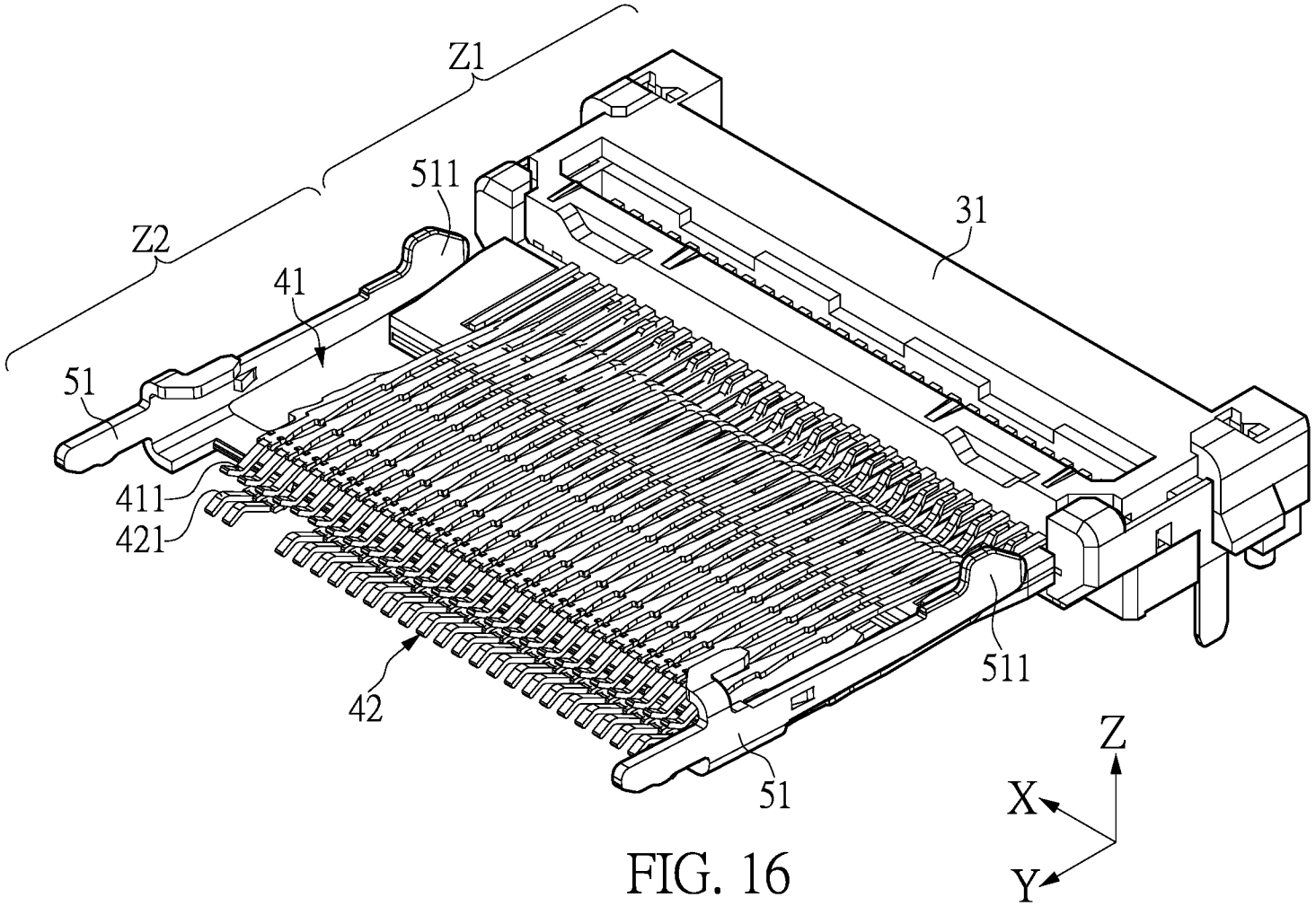
FIG. 16 is a schematic perspective view partially showing a structure of the electrical connector when being mated with a mating electrical connector according to the present disclosure.

Referring to FIG. 14 and FIG. 15, FIG. 14 and FIG. 15 are schematic perspective views of a first cover body, a second cover body, the insulating housing, the first-row terminal assembly, and the second-row terminal assembly of the electrical connector according to the present disclosure. FIG. 14 and FIG. 15 illustrate the full configuration of the electrical connector Z1 according to the present disclosure. For example, the electrical connector Z1 of the present disclosure can be a board end connector. The electrical connector of the present disclosure further includes a first cover body 31 and a second cover body 32. The first cover body 31 is disposed above the insulating housing 2, the first-row terminal assembly U1 is disposed between the first cover body 31 and the insulating housing 2, and a part of the first-row terminal assembly U1 is embedded in the first cover body 31. The second cover body 32 is disposed under the insulating housing 2, the second-row terminal assembly U2 is disposed between the insulating housing 2 and the second cover body 32, and a part of the second-row terminal assembly U2 is embedded in the second cover body 32. Referring also to FIG. 16, the contact areas of each of the terminals of the first-row terminal assembly U1 (i.e., the abovementioned first segment U111, U121, U131) are exposed from the first cover body 31, so as to contact the corresponding terminals of the mating electrical connector during mating, and the contact areas are substantially parallel to the mating direction (the Y-axis). The contact areas of each of the terminals of the second-row terminal assembly U2 (i.e., the abovementioned fifth segment U211, U221, U231, U241) are exposed from the second cover body 32, so as to contact the corresponding terminals of the mating electrical connector during mating, and the contact areas are substantially parallel to the mating direction (the Y-axis).

Figure 17:
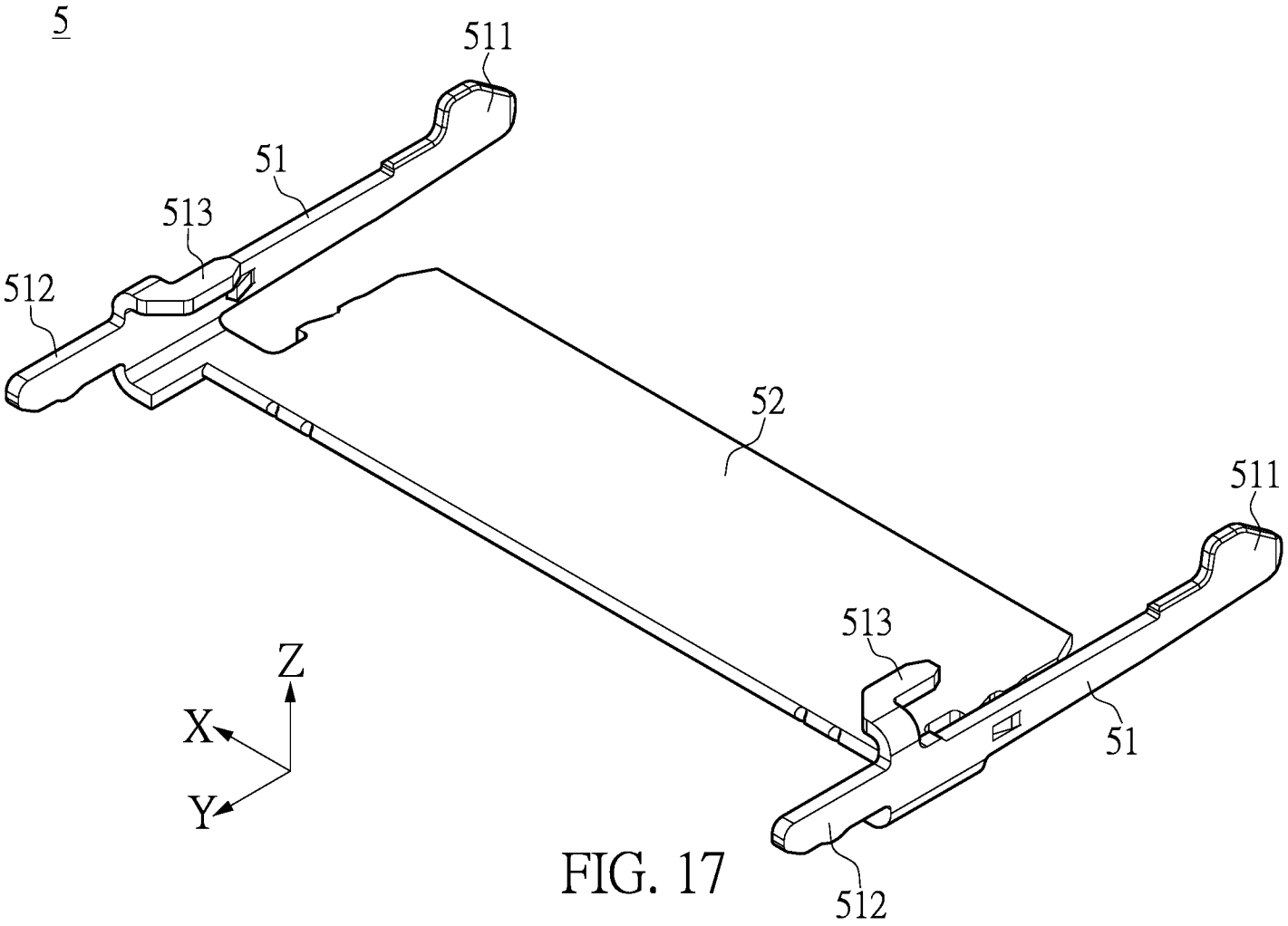
FIG. 17 is a schematic perspective view of a U-shaped rod member of the mating electrical connector according to the present disclosure.

Referring further to FIG. 16, FIG. 16 is partial schematic perspective view of the electrical connector mated with a mating electrical connector according to the present disclosure. In the present embodiment, a mating electrical connector Z2 is a wire end connector. FIG. 17 is a schematic perspective view of a U-shaped rod member of the mating electrical connector according to the present disclosure. The mating electrical connector Z2 includes a plurality of upper extension terminals 41, a plurality of lower extension terminals 42, and a U-shaped rod member 5. One end of each of the plurality of upper extension terminals 41 is correspondingly and electrically connected to each of the terminals of the first-row terminal assembly U1. Another end of each of the plurality of upper extension terminals 41 is bent to form an upper pin 411. One end of each of the plurality of lower extension terminals 42 is correspondingly and electrically connected to each of the terminals of the second-row terminal assembly U2. Another end of each of the plurality of lower extension terminals 42 is bent to form a lower pin 421. The upper pin 411 of each of the plurality of upper extension terminals 41 and the lower pin 421 of each of the plurality of lower extension terminals 42 are arranged opposite to each other in an up-and-down direction (the Z-axis), so as to form an interface for connecting to electronic components (such as cables, circuit boards, and memory cards).

Referring to FIG. 17, FIG. 17 is the schematic perspective view of the U-shaped rod member of the mating electrical connector according to the present disclosure. The U-shaped rod member 5 is made of metal, and has a shield plate 52 and two first support arms 51 that are formed integrally. The shield plate 52 has a shield surface that is perpendicular to the Z-axis (i.e., being parallel to the XY-plane formed by the Y-axis and the X-axis), and is arranged between the plurality of upper extension terminals 41 and the plurality of lower extension terminals 42 to provide the shielding effect. The two first support arms 51 are respectively connected to opposite sides of the shield plate 52. Each of the two first support arms 51 has a support arm surface that is perpendicular to the X-axis or the shield surface.

Each of the two first support arms 51 has a convex part 511, a connecting part 512, and a positioning part 513. The convex part 511 and the connecting part 512 are arranged at opposite ends of the first support arm 51. The positioning part 513 is arranged between the convex part 511 and the connecting part 512, and is parallel to the shield plate 52. That is, the positioning part 513 has a positioning surface that is parallel to the shield surface. Each of the convex parts 511 protrudes perpendicularly to the Y-axis (i.e., the mating direction), so as to stabilize relative positions of the electrical connector Z1 and the mating electrical connector Z2 when being mated with electrical connector Z1.

Figure 18:
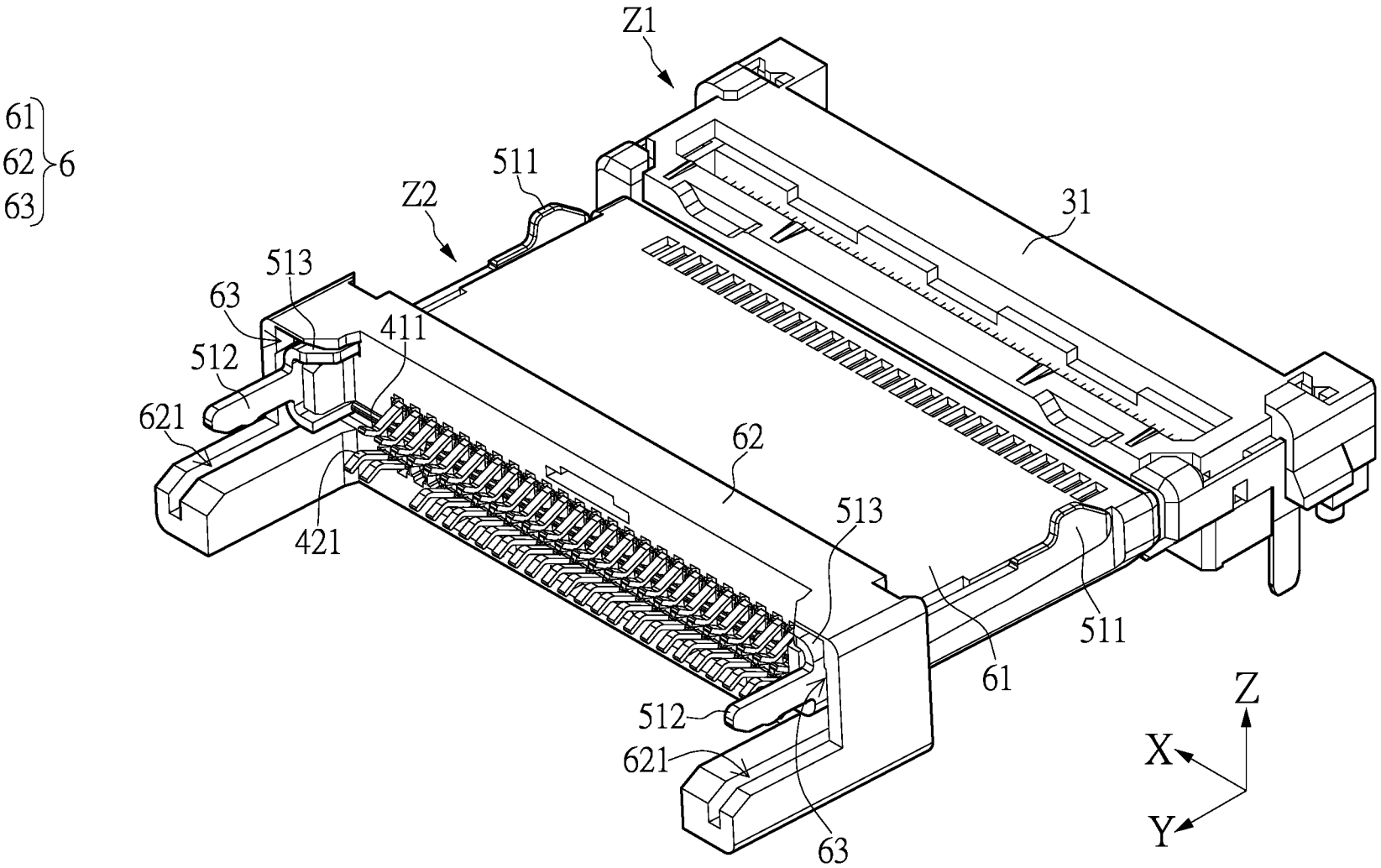
FIG. 18 is another schematic perspective view partially showing the structure of the electrical connector when being mated with the mating electrical connector according to the present disclosure.

Referring to FIG. 18, FIG. 18 is another partial schematic perspective view of the electrical connector mated with the mating electrical connector according to the present disclosure. The mating electrical connector Z2 of the present disclosure further includes a first housing 6. The first housing 6 is an insulating housing, and includes a body part 61 and an opening part 62. The body part 61 has a mating slot (not shown in the figures) arranged therein to receive the tongue structure 21 of the electrical connector Z1 when being mated with the electrical connector Z1. The opening part 62 is connected to one side of the body part 61. Each of the upper extension terminals 41 and each of the lower extension terminals 42 are arranged inside the mating slot, and one end thereof passes through the opening part 62, so that each of the upper pins 411 and each of the lower pins 421 are exposed. The shield plate 52 and the two first support arms 51 of the U-shaped rod member 5 are partially embedded in the first housing 6. The positioning parts 513 of the two first support arms 51 are fittingly engaged in positioning holes 63 arranged on two sides of the opening part 62. The convex parts 511 of the two first support arms 51 are adjacent to opposite sides of the first housing 6. In the present embodiment, the convex parts 511 are correspondingly adjacent to the opposite sides of the body part 61. The connecting parts 512 of the two first support arms 51 are exposed on a rear side of the opening part 62.

Figure 19:
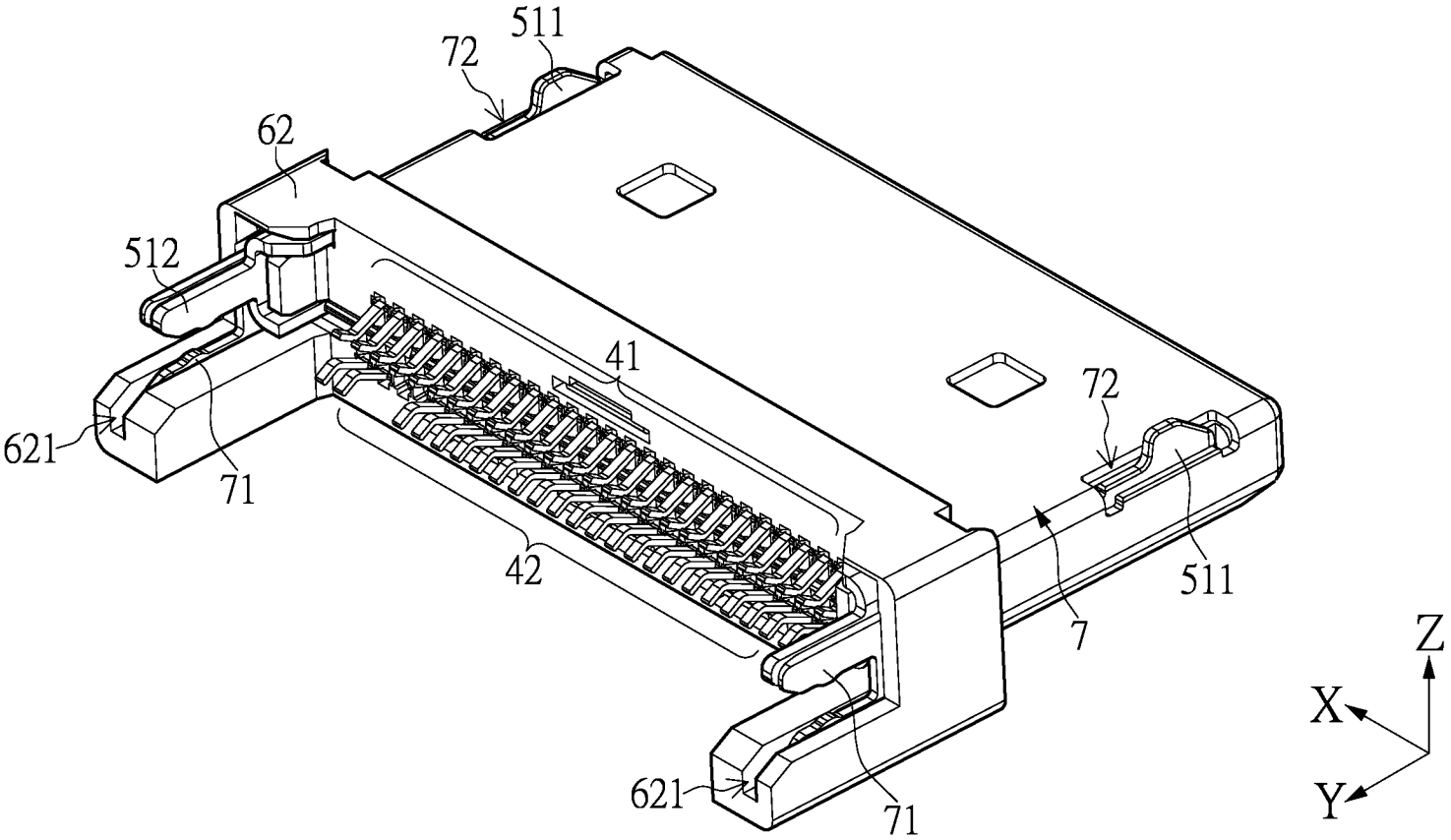
FIG. 19 is a schematic perspective view partially showing the mating electrical connector including a second housing according to the present disclosure.
Figure 20:
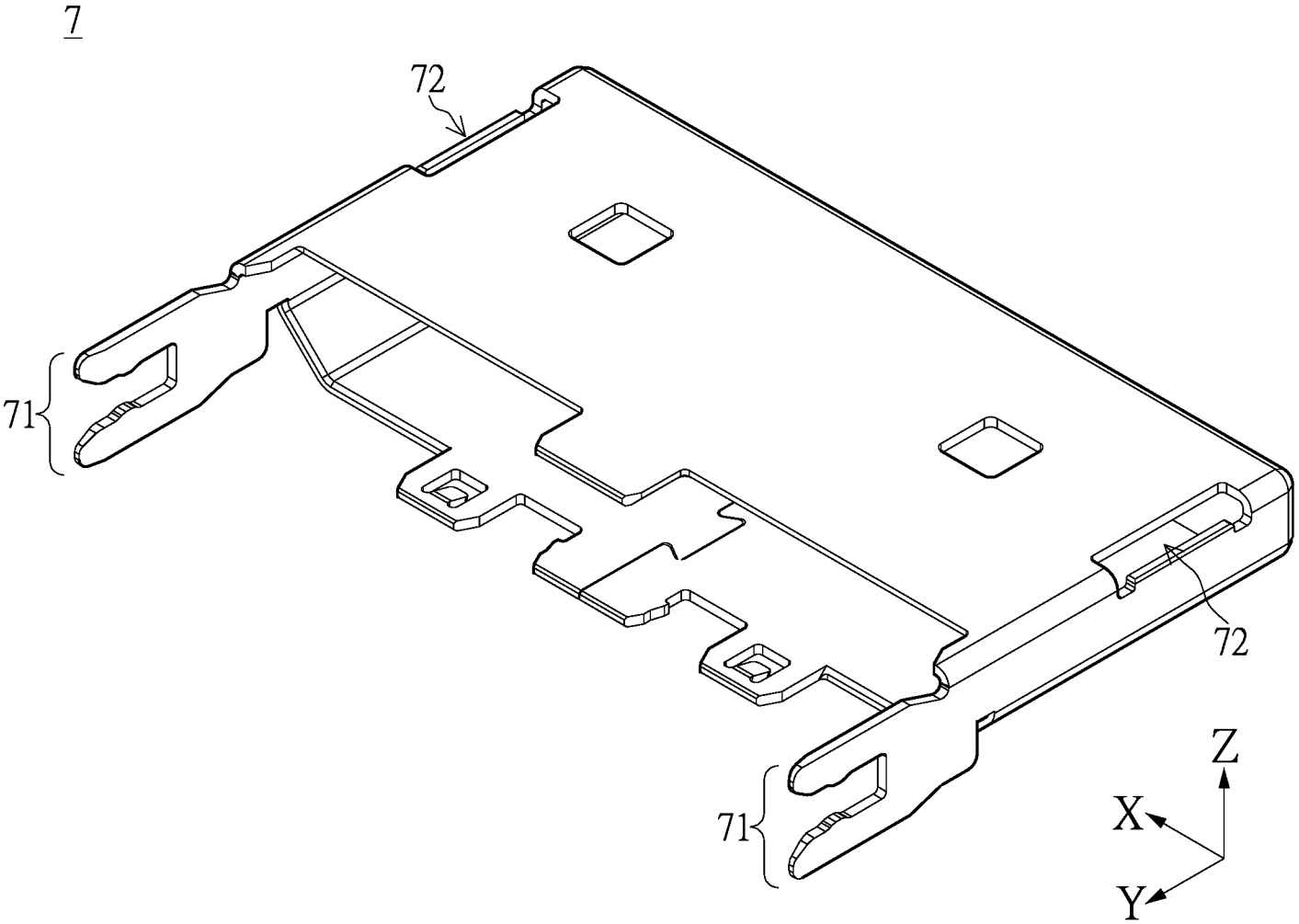
FIG. 20 is a schematic perspective view of the second housing of the mating electrical connector according to the present disclosure.

Referring to FIG. 19 and FIG. 20, FIG. 19 is a partial schematic perspective view of the mating electrical connector including a second housing according to the present disclosure, and FIG. 20 is a schematic perspective view of the second housing of the mating electrical connector according to the present disclosure. The mating electrical connector of the present disclosure further includes a second housing 7. The second housing 7 is a metal hosing, and is integrally formed to strengthen a structure of the wire end connector. The second housing 7 is sleeved on the body part 61 of the first housing 6, and two sides of the second housing 7 each have a second support arm 71. The two second support arms 71 correspondingly pass through two sides of the opening part 62, and are aligned in parallel to the connecting parts 512 of the two first support arms 51. More specifically, the two sides of the opening part 62 each have a groove 621, each of the two second support arms 71 is U-shaped, and a part of the second support arm 71 (i.e., a lower half) is fittingly engaged in the corresponding groove 621. In addition, as shown in FIG. 20, the two sides of the second housing 7 each have a first fittingly engaging hole 72 arranged thereon. When the second housing 7 is sleeved on the body part 61 of the first housing 6, the convex part 511 on each of the two first support arms 51 of the U-shaped rod member 5 is fittingly engaged in the first fittingly engaging hole 72.

Figure 21:
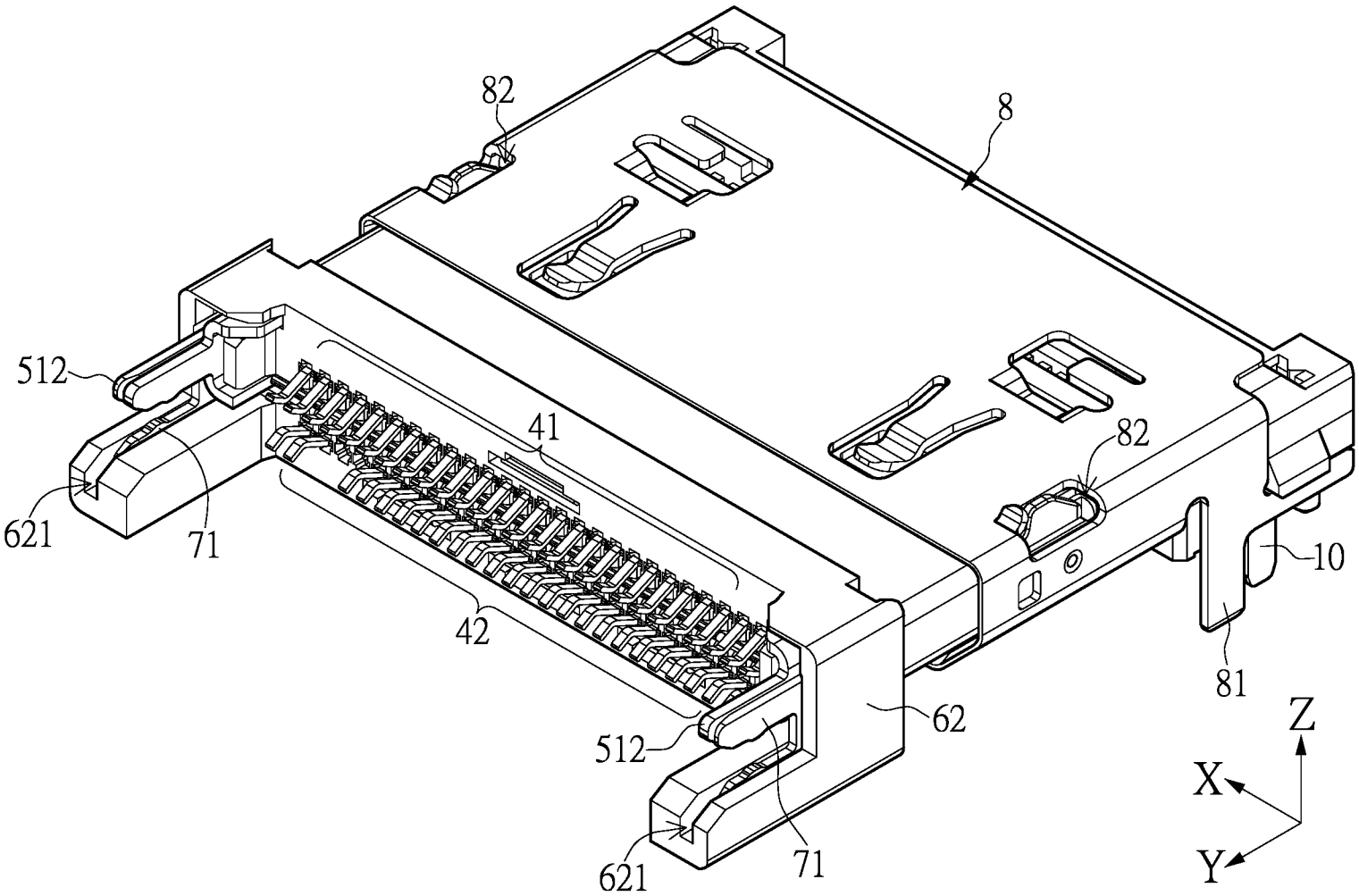
FIG. 21 is a schematic perspective view of the electrical connector being mated with the mating electrical connector according to the present disclosure.

Referring to FIG. 21, FIG. 21 is a schematic perspective view of the electrical connector mated with the mating electrical connector according to the present disclosure. The electrical connector Z1 of the present disclosure further includes a third housing 8 which encloses a part of the second housing 7, a part of the first cover body 31, and a part of the second cover body 32. Two sides of the third housing 8 each have a second plugging part 81 arranged thereon, and each of the second plugging parts 81 extends in the same direction along which each of the first plugging parts 10 extends (both extending in the negative Z-axis). The second plugging part 81 is used for inserting into the circuit board (not shown in the figures). When being mated with the mating electrical connector Z2, the convex part 511 on each of the two first support arms 51 of the U-shaped rod member 5 is fittingly engaged in a second fittingly engaging hole 82.

Figure 22:
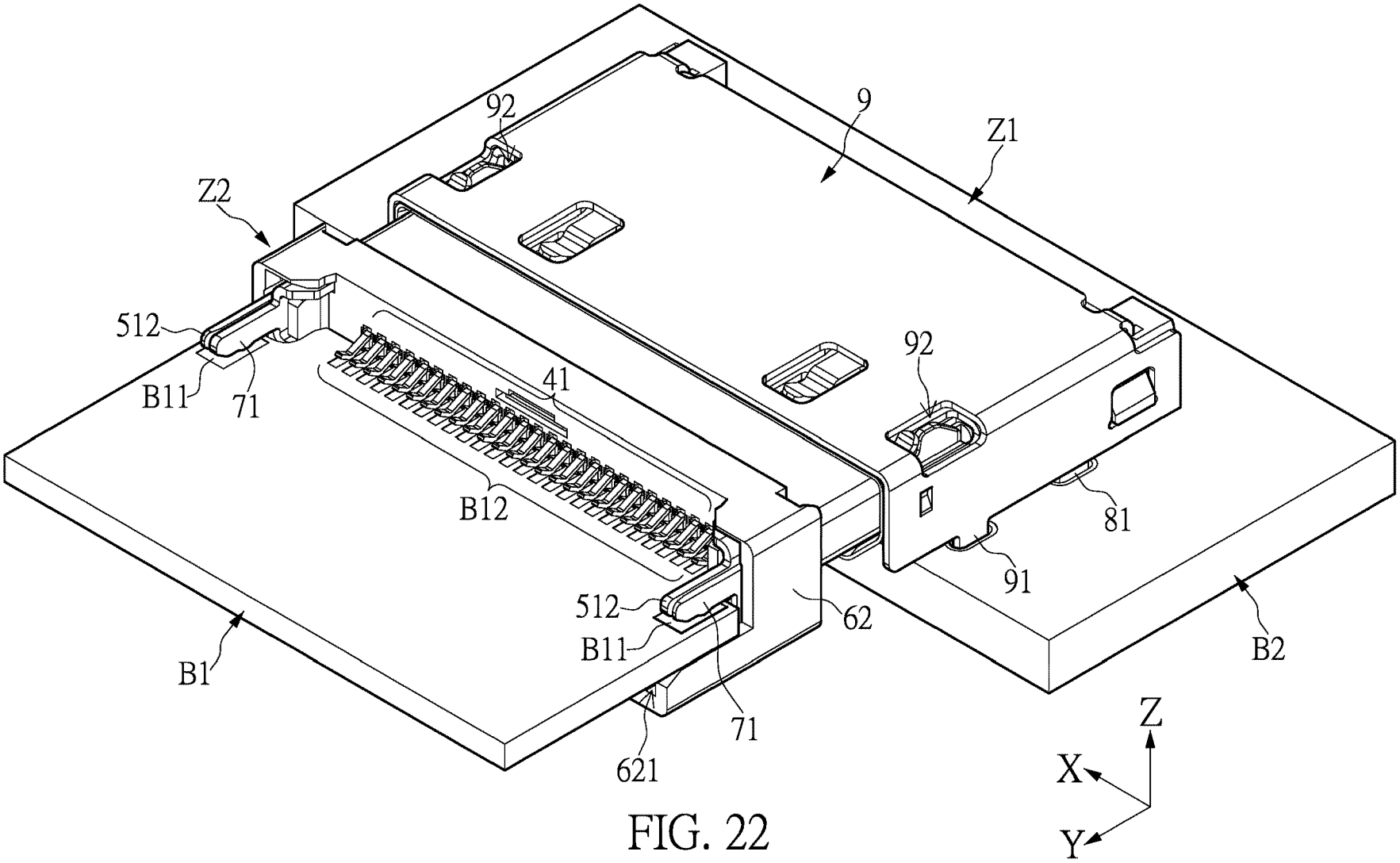
FIG. 22 is a schematic perspective view showing the electrical connector being mated with the mating electrical connector and being inserted into a circuit board according to the present disclosure.

Referring to FIG. 22, FIG. 22 is a schematic perspective view of the electrical connector mated with the mating electrical connector and inserted into a circuit board according to the present disclosure. The electrical connector Z1 of the present disclosure further includes a fourth housing 9, which covers the third housing 8. Two sides of the fourth housing 9 each have a third plugging part 91 arranged thereon, and each of the third plugging parts 91 extends in the same direction along which each of the second plugging parts 81 and each of the first plugging parts 10 extend (both extending in the negative Z-axis). In the present embodiment, the electrical connector Z1 is the board end connector, and the second plugging part 81 and the third plugging part 91 are inserted into a circuit board B2, so as to strengthen a stability between the electrical connector Z1 and the circuit board B2. Two sides of a top surface of the fourth housing 9 each have a third fittingly engaging hole 92 arranged thereon. When the electrical connector Z1 is mated with the mating electrical connector Z2, the convex part 511 on each of the two first support arms 51 of the U-shaped rod member 5 is fittingly engaged in the third fittingly engaging hole 92 (and the second fittingly engaging hole 82 described above).

The mating electrical connector Z2 is electrically connected to an external electronic component B1. Specifically speaking, the mating electrical connector Z2 of the present disclosure is connected to the electronic component B1 (the electronic component B1 may be an electronic card, a circuit board, a cable, etc., such as a memory card, a graphic card, a network card, but is not limited thereto) through the interface formed by the upper pins 411 of the plurality of upper extension terminals 41 and the lower pins 421 of the plurality of lower extension terminals 42. In the present embodiment, the mating electrical connector Z2 is the wire end connector, the electronic component B1 is the circuit board, and the electronic component B1 is connected to the cable (not shown in the figures).

Figure 23:
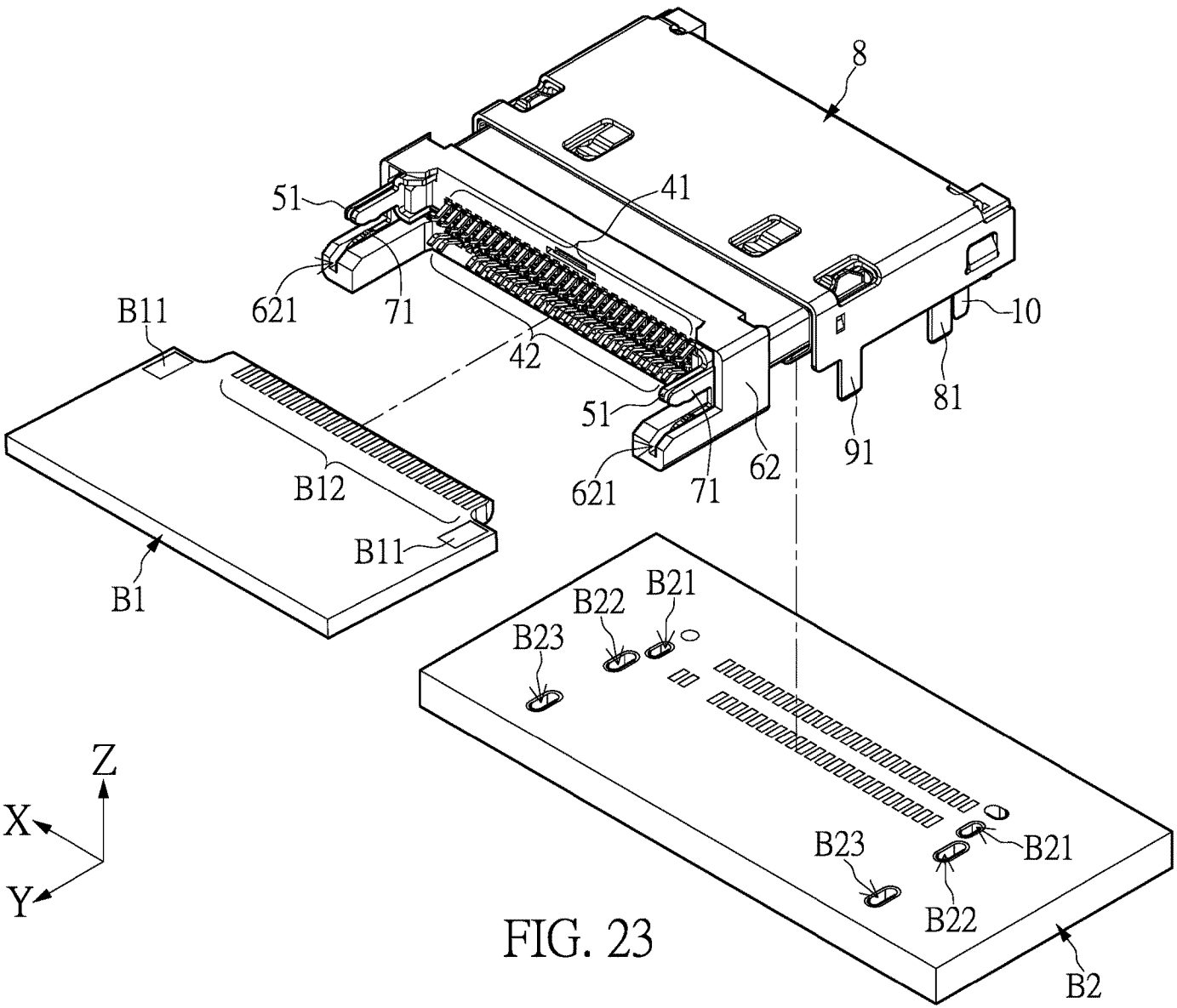
FIG. 23 is a schematic exploded view showing the electrical connector being mated with the mating electrical connector and being inserted into the circuit board according to the present disclosure.

For example, referring to FIG. 22 and FIG. 23, FIG. 23 is a schematic exploded view of the electrical connector mated with the mating electrical connector and inserted into the circuit board according to the present disclosure. The external electronic component B1 is connected to the interface, and the external electronic component B1 has a plurality of terminal transition parts B12 that correspondingly and electrically contact the upper pins 411 of the plurality of upper extension terminals 41 and the lower pins 421 of the plurality of lower extension terminals 42, so that the electronic component B1 (or the cable connected to the electronic component B1) is electrically connected to the mating electrical connector Z2 of the present disclosure and carries out signal transmission. The connecting parts 512 of the two opposite first support arms 51 of the U-shaped rod member 5 and the second support arms 71 on the two sides of the second housing 7 are electrically connected to at least one ground part B11 of the electronic component B1, so that the U-shaped rod member 5 and the second housing 7 are grounded to provide the shielding effect. The electrical connector Z1 is inserted into a second through hole B22 and a third through hole B23 on the circuit board B2 respectively through the second plugging part 81 and the third plugging part 91, so as to strengthen the stability between the electrical connector Z1 and the circuit board B2. In addition, the electrical connector Z1 is inserted into a first through hole B21 on the circuit board B2 through the first plugging part 10, and the first through hole B21 is grounded, so that the metal plate 1 is grounded. The first-row terminal assembly U1 and the second-row terminal assembly U2 of the electrical connector Z1 are correspondingly and electrically connected to a plurality of solder pads of the circuit board B2 for signal transmission.

Beneficial Effects of the Embodiment

In conclusion, one of the beneficial effects of the present disclosure is that, in the electrical connector provided by the present disclosure, by virtue of "the hollow area 100 having the first projection area on the projection plane that is parallel to the metal plate 1, the contact area of the second power terminal set having the second projection area on the projection plane, the first projection area completely overlapping the second projection area, the first projection area having the first border line L1 and the second border line L2 that are opposite to each other, the second projection area having the third border line L3 and the fourth border line L4 that are opposite to each other, the first border line L1 and the third border line L3 having the first projection distance D1 therebetween, the second border line L2 and the fourth border line L4 having the second projection distance D3 therebetween, and the first projection distance D and the second projection distance D3 both being 0.2 mm or more" and "the second ground terminal set, the at least one first signal terminal U13, and the at least one second signal terminal U23 being arranged in the shield segment SS, and the second power terminal set being arranged in the electric arc suppression segment AR", the quiet zone surrounding the terminals is enlarged to avoid damage to the structure surrounding the terminals caused by the electric arc effect.

Furthermore, in the present disclosure, the first power terminal U11 is spaced apart from the second power terminal U21 by the first predetermined distance D1, and the second power terminal set is spaced apart from the second ground terminal by the second predetermined distance D2, so that the range of the quiet zone surrounding the second power terminal U21 (the power terminal) is increased, thereby preventing the surrounding structure from being damaged due to the electric arc generated by the second power terminal U21 during conduction of electricity.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An electrical connector, comprising:

a metal plate having a hollow area;

a first-row terminal assembly disposed on one side of the metal plate, the first-row terminal assembly including at least one first signal terminal; and a second-row terminal assembly disposed on another side of the metal plate, wherein the second-row terminal assembly is opposite to the first-row terminal assembly, and the second-row terminal assembly includes a second power terminal set, a second ground terminal set, and at least one second signal terminal, and wherein a contact area of the second power terminal set is configured in physical contact with one terminal set of a mating electrical connector when the contact area of the second power terminal set is mated with the mating electrical connector;

wherein the hollow area has a first projection area on a projection plane that is parallel to the metal plate, the contact area of the second power terminal set has a second projection area perpendicularly projected onto the projection plane, the first projection area completely overlaps the second projection area, the first projection area has a first border line and a second border line that are opposite to each other, the second projection area has a third border line and a fourth border line that are opposite to each other, the first border line and the third border line have a first projection distance therebetween, the second border line and the fourth border line have a second projection distance therebetween, and the first projection distance and the second projection distance are both 0.2 mm or more.

2. The electrical connector according to claim 1, wherein the second ground terminal set is adjacent to the second power terminal set.

3. The electrical connector according to claim 2, wherein the second ground terminal set and the at least one second signal terminal are arranged at a first pin pitch along an alignment direction, the second ground terminal set and the second power terminal set are adjacent to each other and spaced apart at a second pin pitch, and the second pin pitch is greater than the first pin pitch.

4. The electrical connector according to claim 1, wherein the second power terminal set is not adjacent to the at least one second signal terminal.

5. The electrical connector according to claim 1, wherein the hollow area has a convex area, and a border of the convex area overlaps one of the first border line and the second border line of the projection area on the projection plane.

6. The electrical connector according to claim 1, wherein a minimum distance between the second power terminal set and the metal plate is 0.23 mm or more.

7. The electrical connector according to claim 1, wherein the second power terminal set, the second ground terminal set and the at least one second signal terminal extend forwardly along a mating direction, and a foremost end of any terminal of the second power terminal set is arranged in back of a foremost end of any terminal of the second ground terminal set.

8. The electrical connector according to claim 7, wherein the foremost end of any terminal of the second power terminal set is arranged in front of a foremost end of the at least one second signal terminal.

9. The electrical connector according to claim 1, wherein one of the first-row terminal assembly and the second-row terminal assembly further includes a detection terminal set, the detection terminal set extends forwardly along a mating direction, and a foremost end of any terminal of the detection terminal set is arranged in back of a foremost end of the at least one first signal terminal and a foremost end of the at least one second signal terminal.

10. The electrical connector according to claim 1, wherein the first-row terminal assembly further includes a first power terminal set, a contact area of the first power terminal set is configured in physical contact with another terminal set of the mating electrical connector when the contact area of the first power terminal set is mated with the mating electrical connector, the contact area of the first power terminal set has a third projection area on the projection plane, and the first projection area completely overlaps the third projection area.

11. The electrical connector according to claim 10, wherein the first-row terminal assembly further includes a first ground terminal set disposed between the first power terminal set and the at least one first signal terminal.

12. An electrical connector, comprising:

a metal plate divided into a shield segment and an electric arc suppression segment by a boundary line, the boundary line extending along a mating direction, the metal plate including a main body part, and the main body part being arranged in the shield segment;

a first-row terminal assembly disposed on one side of the metal plate, the first-row terminal assembly including at least one first signal terminal, and the at least one first signal terminal extending along the mating direction; and a second-row terminal assembly disposed on another side of the metal plate, the second-row terminal assembly being opposite to the first-row terminal assembly, the second-row terminal assembly including a second power terminal set, a second ground terminal set, and at least one second signal terminal, the second power terminal set, the second ground terminal set, and the at least one second signal terminal extending along the mating direction and being arranged along an alignment direction, and the alignment direction being perpendicular to the mating direction;

wherein the second ground terminal set, the at least one first signal terminal, and the at least one second signal terminal are arranged in the shield segment, and the second power terminal set is arranged in the electric arc suppression segment;

wherein a contact area of the second power terminal set is configured in physical contact with one terminal set of a mating electrical connector when the contact area of the second power terminal set is mated with the mating electrical connector;

wherein an edge of the contact area of the second power terminal set and the boundary line are spaced apart from each other along the alignment direction.

13. The electrical connector according to claim 12, wherein the metal plate includes at least one extension arm, and the at least one extension arm extends from the main body part to the electric arc suppression segment.

14. The electrical connector according to claim 13, wherein a hollow area is formed by the main body part and the at least one extension arm, the hollow area is arranged on the electric arc suppression segment, and a border line of the hollow area that is adjacent to the main body part overlaps the boundary line.

15. The electrical connector according to claim 12, wherein the second ground terminal set is adjacent to the second power terminal set.

16. The electrical connector according to claim 15, wherein the second ground terminal set and the at least one second signal terminal are arranged at a first pin pitch along an alignment direction, the second ground terminal set and the second power terminal set are adjacent to each other and spaced apart at a second pin pitch, and the second pin pitch is greater than the first pin pitch.

17. The electrical connector according to claim 12, wherein the first-row terminal assembly further includes a first power terminal set, and the first power terminal set is arranged in the electric arc suppression segment.

18. The electrical connector according to claim 17, wherein the first-row terminal set further includes a first ground terminal set, and the first ground terminal set is arranged in the shield segment and is adjacent to the first power terminal set.

19. The electrical connector according to claim 12, wherein terminals of the first-row terminal assembly and terminals of the second-row terminal assembly each have a pin for connection to a circuit board, and the pin of each of the terminals of the first-row terminal assembly and the pin of each of the terminals of the second-row terminal assembly are arranged in a staggered manner along the alignment direction.

20. The electrical connector according to claim 12, wherein at least one second power terminal is electrically connected to a power supply potential, and a maximum potential value of the power supply potential is 24 V or greater.

21. The electrical connector according to claim 12, wherein the main body part includes at least one positioning through hole.

* * * * *